US008613624B2

(12) United States Patent
Arenas et al.

(10) Patent No.: US 8,613,624 B2
(45) Date of Patent: Dec. 24, 2013

(54) MODULAR WIRING SYSTEM WITH LOCKING ELEMENTS

(75) Inventors: Alfredo Arenas, Little Neck, NY (US); Paul Endres, Plainview, NY (US); John Eder, Floral Park, NY (US); Sunil Ganta, Plainview, NY (US)

(73) Assignee: Leviton Manufacturing Company, Inc., Melville, NY (US)

( * ) Notice: Subject to any disclaimer, the term of this patent is extended or adjusted under 35 U.S.C. 154(b) by 0 days.

(21) Appl. No.: 13/099,318

(22) Filed: May 2, 2011

(65) Prior Publication Data

US 2011/0205698 A1 Aug. 25, 2011

Related U.S. Application Data

(63) Continuation of application No. 12/685,656, filed on Jan. 11, 2010, now Pat. No. 7,955,096.

(51) Int. Cl.
*H01R 4/66* (2006.01)

(52) U.S. Cl.
USPC ..... 439/107; 439/535

(58) Field of Classification Search
USPC ..... 439/107, 135, 337, 535, 656, 864
See application file for complete search history.

(56) References Cited

U.S. PATENT DOCUMENTS

| | | | | |
|---|---|---|---|---|
| 1,938,309 | A | | 12/1933 | Williams |
| 1,938,917 | A | | 12/1933 | Loetscher |
| 2,238,386 | A | | 4/1941 | Frank |
| 2,397,688 | A | | 4/1946 | Osinski |
| 2,399,688 | A | | 5/1946 | Metzner et al. |
| 2,433,917 | A | | 1/1948 | McCartney |
| 2,466,930 | A | | 4/1949 | Cook |
| 2,515,256 | A | | 4/1950 | O'Brien et al. |
| 2,644,144 | A | * | 6/1953 | Richardson ..... 439/656 |
| 2,763,847 | A | | 9/1956 | Hubbell |
| 2,892,174 | A | | 6/1959 | Benander |
| 2,937,688 | A | | 5/1960 | Kirchner |
| 2,941,178 | A | * | 6/1960 | Hubbell et al. ..... 439/333 |
| 2,969,518 | A | | 1/1961 | Slater |
| 2,985,334 | A | | 5/1961 | Slater |
| 3,002,175 | A | | 9/1961 | Bertram et al. |
| 3,023,394 | A | * | 2/1962 | Hubbell ..... 439/337 |
| 3,038,141 | A | | 6/1962 | Chiuchiolo |

(Continued)

FOREIGN PATENT DOCUMENTS

| | | |
|---|---|---|
| CA | 1182583 | 2/1985 |
| JP | 6014026 | 1/1994 |
| JP | 10-321326 | 4/1998 |

OTHER PUBLICATIONS

Office Action dated Jul. 13, 2011 for U.S. Appl. No. 13/099,318.

(Continued)

*Primary Examiner* — Amy Cohen Johnson
*Assistant Examiner* — Vladimir Imas
(74) *Attorney, Agent, or Firm* — Collard & Roe, P.C.

(57) ABSTRACT

A wiring system includes a wiring module and a functional module. The wiring module in at least one embodiment includes elongated holes or openings which are configured to engage or lock with prongs on a functional module to create a lockable connection. The wiring module and the functional module form both a physical and an electrical connection. In another embodiment, there is an adapter which is configured to connect the wiring module and the functional module or unit together.

20 Claims, 36 Drawing Sheets

(56) References Cited

U.S. PATENT DOCUMENTS 3,120,987 A * 2/1964 Degnan et al. ..... 439/588
3,121,599 A * 2/1964 Modrey ..... 439/346
3,156,761 A 11/1964 Schinske
3,178,674 A 4/1965 Scheller
3,233,204 A * 2/1966 De Vore, Jr. ..... 439/333
3,268,851 A 8/1966 Mancini
3,390,404 A * 6/1968 Murchison ..... 439/148
3,500,291 A * 3/1970 Hubbell et al. ..... 439/337
3,510,822 A 5/1970 Patterson
3,551,880 A * 12/1970 Hartwell ..... 439/314
3,609,647 A 9/1971 Castellano
3,641,472 A 2/1972 Phillips, Jr.
3,685,007 A * 8/1972 Riley et al. ..... 439/674
3,699,499 A * 10/1972 Spaderna ..... 439/337
3,716,651 A 2/1973 Werner
3,723,948 A 3/1973 Wyatt et al.
3,781,769 A * 12/1973 Wiley ..... 439/682
3,852,513 A 12/1974 Flahive
3,858,161 A 12/1974 Champion et al.
3,868,161 A 2/1975 Frantz
3,879,101 A 4/1975 McKissic
3,879,109 A 4/1975 Thomas
3,945,702 A * 3/1976 Poliak et al. ..... 439/337
3,957,336 A 5/1976 Bromberg
3,975,074 A 8/1976 Fuller
3,999,829 A 12/1976 Glaesel
4,075,758 A 2/1978 Parsons et al.
4,165,443 A 8/1979 Figart et al.
4,166,934 A 9/1979 Marrero
4,213,667 A * 7/1980 Wittes ..... 439/469
4,243,957 A 1/1981 Schmidt
4,245,880 A 1/1981 Zimmerman, Jr. et al.
4,255,007 A * 3/1981 Michaels et al. ..... 439/332
4,273,957 A 6/1981 Kolling, Jr.
4,289,921 A 9/1981 Gartner et al.
4,295,018 A 10/1981 Borrelli
4,336,418 A 6/1982 Hoag
4,386,820 A 6/1983 Dola et al.
4,399,371 A 8/1983 Ziff et al.
4,443,654 A 4/1984 Flachbarth et al.
4,477,141 A 10/1984 Hardesty
4,479,692 A 10/1984 Greenwood et al.
4,531,798 A * 7/1985 Baur et al. ..... 439/368
4,545,632 A 10/1985 Maier et al.
4,550,967 A * 11/1985 Riches et al. ..... 439/332
4,553,000 A * 11/1985 Appleton ..... 200/50.29
4,555,418 A 11/1985 Snider et al.
4,589,719 A 5/1986 Gentry et al.
4,606,595 A 8/1986 Dola
4,627,675 A 12/1986 Taylor et al.
4,657,334 A * 4/1987 Simmons ..... 439/221
4,669,804 A 6/1987 Munroe
4,699,804 A 10/1987 Miyata et al.
4,725,249 A 2/1988 Blackwood et al.
4,759,726 A 7/1988 Naylor et al.
4,842,551 A 6/1989 Heimann
4,875,871 A 10/1989 Booty, Sr. et al.
4,917,625 A 4/1990 Haile
4,918,258 A 4/1990 Ayer
4,960,388 A 10/1990 Frantz et al.
5,015,203 A 5/1991 Furrow
5,043,531 A 8/1991 Gutenson et al.
5,046,961 A * 9/1991 Hoffman ..... 439/141
5,057,646 A 10/1991 Nichols et al.
5,092,787 A 3/1992 Wise et al.
5,117,122 A 5/1992 Hogarth et al.
5,135,417 A 8/1992 Stanevich
D329,422 S 9/1992 Fujiyoshi
5,160,808 A 11/1992 Hadfield
5,162,611 A 11/1992 Nichols, III et al.
5,167,542 A * 12/1992 Haitmanek ..... 439/681
5,178,555 A 1/1993 Kilpatrick et al.
5,185,580 A 2/1993 Nichols, III et al.
5,190,468 A 3/1993 Nichols, III et al.
5,234,355 A * 8/1993 Sosinski et al. ..... 439/337
D340,912 S 11/1993 Miller
D340,913 S 11/1993 Miller
D341,125 S 11/1993 Miller
5,266,046 A 11/1993 Bogiel
5,297,973 A 3/1994 Gorman
5,328,387 A * 7/1994 Hoffman ..... 439/469
5,352,122 A * 10/1994 Speyer et al. ..... 439/13
5,397,806 A 3/1995 Soled et al.
5,397,929 A 3/1995 Hogarth et al.
5,399,806 A 3/1995 Olson
5,472,350 A 12/1995 Mehta
5,582,522 A 12/1996 Johnson
5,584,714 A 12/1996 Karst et al.
5,605,466 A 2/1997 Devlin et al.
5,641,310 A * 6/1997 Tiberio, Jr. ..... 439/680
5,662,500 A 9/1997 Yeah
5,680,926 A * 10/1997 Sandor et al. ..... 200/51.08
5,741,149 A * 4/1998 Anthony ..... 439/333
5,785,551 A 7/1998 Libby
5,816,733 A * 10/1998 Ishikawa et al. ..... 403/329
D405,761 S 2/1999 Yu
5,865,633 A 2/1999 Hou
D411,170 S * 6/1999 Deutsch ..... D13/146
5,964,618 A 10/1999 McCarthy
5,975,938 A 11/1999 Libby
6,028,268 A 2/2000 Stark et al.
6,045,374 A 4/2000 Candeloro
6,071,132 A 6/2000 Cook
D430,539 S 9/2000 Leopold et al.
6,154,774 A 11/2000 Furlong et al.
D434,726 S 12/2000 Middlehurst
D434,729 S 12/2000 Hwang
6,156,971 A 12/2000 May
6,171,129 B1 * 1/2001 Phillips ..... 439/346
6,203,349 B1 * 3/2001 Nakazawa ..... 439/319
6,287,152 B1 * 9/2001 Yang ..... 439/644
6,287,156 B1 9/2001 Swan et al.
6,309,248 B1 10/2001 King
6,319,016 B1 11/2001 Juntwait
6,328,581 B1 * 12/2001 Lee et al. ..... 439/106
6,341,981 B1 * 1/2002 Gorman ..... 439/535
6,376,770 B1 4/2002 Hyde
6,417,450 B1 7/2002 Young
6,457,988 B1 10/2002 Andersen
6,494,728 B1 12/2002 Gorman
6,515,564 B2 2/2003 Leopold et al.
6,544,049 B1 4/2003 Pierson, Jr.
6,558,190 B1 5/2003 Pierson, Jr.
6,563,049 B2 5/2003 May
6,617,511 B2 9/2003 Schultz et al.
6,669,495 B2 * 12/2003 Philips et al. ..... 439/170
6,739,900 B2 * 5/2004 Mortun et al. ..... 439/469
6,767,245 B2 7/2004 King
6,774,307 B2 8/2004 Kruse et al.
6,817,873 B1 11/2004 Gorman
6,829,124 B2 12/2004 Leopold et al.
6,831,226 B2 12/2004 Allen, Jr.
6,843,680 B2 1/2005 Gorman
6,843,682 B2 * 1/2005 Matsuda et al. ..... 439/596
6,845,023 B2 1/2005 Philips et al.
6,857,903 B2 2/2005 Hyde
6,863,561 B2 3/2005 Gorman
6,870,099 B1 3/2005 Schultz et al.
6,872,103 B1 3/2005 Flieger et al.
6,876,888 B2 4/2005 Locke
6,884,111 B2 4/2005 Gorman
6,893,297 B2 5/2005 Chen
6,894,221 B2 5/2005 Gorman
6,939,179 B1 9/2005 Kieffer, Jr. et al.
6,945,815 B1 9/2005 Mullally
6,955,559 B2 10/2005 Pyrros
6,979,212 B1 12/2005 Gorman
6,986,674 B1 1/2006 Gorman
6,994,585 B2 2/2006 Benoit et al.
7,004,595 B1 2/2006 Stoddard
7,008,246 B2 3/2006 Zhuge
7,031,602 B2 * 4/2006 Faries et al. ..... 392/470
7,052,313 B2 5/2006 Gorman
7,058,525 B2 * 6/2006 Bertness et al. ..... 702/63

(56) References Cited

U.S. PATENT DOCUMENTS

| | | | | |
|---|---|---|---|---|
| 7,060,897 | B2 | 6/2006 | Gorman | |
| 7,081,009 | B2 | 7/2006 | Gorman | |
| 7,081,010 | B2 | 7/2006 | Gorman | |
| 7,101,187 | B1 | 9/2006 | Deconinck et al. | |
| 7,104,836 | B1 | 9/2006 | Gorman | |
| 7,150,660 | B2 | 12/2006 | Allgood et al. | |
| 7,160,149 | B1 * | 1/2007 | Chawgo | 439/578 |
| 7,168,969 | B1 | 1/2007 | Wang | |
| D537,414 | S | 2/2007 | Saito | |
| 7,175,463 | B2 * | 2/2007 | Burton | 439/346 |
| 7,189,110 | B1 | 3/2007 | Savicki, Jr. | |
| 7,195,517 | B1 | 3/2007 | Savicki, Jr. | |
| 7,223,126 | B2 | 5/2007 | Ng | |
| 7,234,962 | B1 * | 6/2007 | Lin | 439/441 |
| D547,721 | S | 7/2007 | Harano et al. | |
| 7,265,291 | B1 | 9/2007 | Gorman | |
| 7,273,392 | B2 | 9/2007 | Fields | |
| 7,285,009 | B1 | 10/2007 | Benoit et al. | |
| 7,321,120 | B1 | 1/2008 | Gorman et al. | |
| D563,877 | S | 3/2008 | Grant | |
| 7,357,652 | B1 * | 4/2008 | Arenas et al. | 439/107 |
| 7,367,121 | B1 | 5/2008 | Gorman | |
| 7,407,410 | B1 | 8/2008 | Benoit et al. | |
| 7,459,632 | B2 | 12/2008 | Bowman | |
| 7,470,145 | B1 | 12/2008 | Savicki, Jr. et al. | |
| 7,491,101 | B2 | 2/2009 | Irish et al. | |
| 7,509,732 | B2 | 3/2009 | Kumakura | |
| 7,510,429 | B1 | 3/2009 | Savicki, Jr. et al. | |
| 7,528,609 | B2 | 5/2009 | Savicki, Jr. et al. | |
| 7,537,472 | B1 * | 5/2009 | Schwarz et al. | 439/188 |
| 7,563,131 | B2 | 7/2009 | Sullivan et al. | |
| 7,597,570 | B2 * | 10/2009 | So | 439/172 |
| 7,601,023 | B1 * | 10/2009 | Ma et al. | 439/518 |
| 7,632,119 | B1 | 12/2009 | Ma et al. | |
| 7,632,137 | B1 | 12/2009 | Ma et al. | |
| 7,666,010 | B2 * | 2/2010 | Arenas et al. | 439/107 |
| 7,713,084 | B1 | 5/2010 | Weeks et al. | |
| 7,722,389 | B2 | 5/2010 | Benoit et al. | |
| D616,831 | S | 6/2010 | Arenas et al. | |
| D618,627 | S | 6/2010 | Arenas et al. | |
| 7,780,470 | B2 | 8/2010 | Benoit et al. | |
| 7,955,096 | B2 | 6/2011 | Arenas et al. | |
| 8,182,285 | B2 | 5/2012 | Annequin et al. | |
| 2002/0052139 | A1 * | 5/2002 | Gorman | 439/557 |
| 2002/0055301 | A1 * | 5/2002 | Gorman | 439/535 |
| 2002/0064983 | A1 * | 5/2002 | Patey | 439/152 |
| 2003/0236011 | A1 | 12/2003 | Gorman | |
| 2004/0130218 | A1 | 7/2004 | Locke | |
| 2004/0206541 | A1 | 10/2004 | Locke | |
| 2004/0266236 | A1 * | 12/2004 | Hughes | 439/152 |
| 2005/0006124 | A1 | 1/2005 | Kruse et al. | |
| 2005/0070161 | A1 | 3/2005 | Dunwoody | |
| 2005/0075007 | A1 | 4/2005 | Benoit et al. | |
| 2005/0250377 | A1 | 11/2005 | Gorman | |
| 2005/0250378 | A1 | 11/2005 | Gorman | |
| 2005/0272304 | A1 | 12/2005 | Gorman | |
| 2005/0272305 | A1 | 12/2005 | Gorman | |
| 2006/0030183 | A1 | 2/2006 | Yoshida et al. | |
| 2006/0286874 | A1 * | 12/2006 | Ritchie | 439/762 |
| 2008/0149551 | A1 * | 6/2008 | Brugger et al. | 210/232 |
| 2008/0207046 | A1 * | 8/2008 | Arenas et al. | 439/535 |
| 2008/0268679 | A1 | 10/2008 | Tiberio et al. | |
| 2009/0053925 | A1 | 2/2009 | Pyrros | |
| 2009/0197461 | A1 | 8/2009 | Benoit et al. | |
| 2009/0227122 | A1 * | 9/2009 | Jubelirer et al. | 439/11 |
| 2010/0120274 | A1 | 5/2010 | Arenas et al. | |
| 2010/0227484 | A1 | 9/2010 | Arenas et al. | |

OTHER PUBLICATIONS

International Search Report and the Written Opinion of the International Searching Authority mailed on May 7, 2008 for PCT/US2007/082460 filed on Oct. 25, 2007; 9 pages.

International Preliminary Report on Patentability for PCT/US2007/082460; Mailed on Apr. 28, 2009; 8 pages.

"Practical Electrical Wiring" by Herbert P. Richter and W. Creighton Schwan, 17th edition, Chapter 8, New York: McGraw-Hill Companies, 1996, 13 pages.

BRK Electronics; User's Manual—Smoke Alarms; Jun. 2000, as disclosed in Reissue 95/000200.

U.S. Office Action Mailed on Jul. 3, 2007 for U.S. Appl. No. 11/553,793, filed Oct. 27, 2006 which was issued as U.S. Patent No. 7,357,652 on Apr. 15, 2008.

Notice of Allowance Mailed on Nov. 26, 2007 for U.S. Appl. No. 11/553,793, filed Oct. 27, 2006 which was Issued as U.S. Patent No. 7,357,652 on Apr. 15, 2008.

U.S. Office Action Mailed on Jan. 6, 2009 for U.S. Appl. No. 12/040,648, filed Feb. 29, 2008 which was issued as U.S. Patent No. 7,666,010 on Feb. 23, 2010.

U.S. Final Office Action Mailed on Jun. 8, 2009 for U.S. Appl. No. 12/040,648, filed Feb. 29, 2008 which was Issued as U.S. Patent No. 7,666,010 on Feb. 23, 2010.

Notice of Allowance Mailed on Oct. 6, 2009 for U.S. Appl. No. 12/040,648, filed Feb. 29, 2008 which was Issued as U.S. Patent No. 7,666,010 on Feb. 23, 2010.

Notice of Allowance Mailed on Jan. 14, 2010 for U.S. Appl. No. 12/040,648, filed Feb. 29, 2008 which was issued as U.S. Patent No. 7,666,010 on Feb. 23, 2010.

U.S. Notice of Allowance Mailed on May 14, 2010 for U.S. Appl. No. 29/337,364, filed May 20, 2009 which was issued as U.S. Design Patent D.618,227 on Jun. 29, 2010.

U.S. Notice of Allowance Mailed on Jul. 9, 2008 for U.S. Appl. No. 29/284,192, filed Sep. 1, 2007.

U.S. Notice of Allowance Mailed on Jan. 26, 2010 for U.S. Appl. No. 29/327,447, filed Nov. 5, 2008 which issued as U.S. Design Patent D.616,831 on Jun. 1, 2010.

U.S. Office Action Mailed on Aug. 20, 2010 for U.S. Appl. No. 12/689,163, filed Jan. 18, 2010.

U.S. Final Office Action Mailed on Dec. 3, 2010 for U.S. Appl. No. 12/689,163, filed Jan. 18, 2010.

U.S. Office Action Mailed on Mar. 11, 2011 for U.S. Appl. No. 12/689,163 filed Jan. 18, 2010.

U.S. Final Office Action Mailed on Jun. 27, 2011 for U.S. Appl. No. 12/689,163, filed Jan. 18, 2010.

U.S. Office Action Mailed on Oct. 18, 2010 for U.S. Appl. No. 12/685,656, filed Jan. 11, 2010 which was issued as U.S. Patent No. 7,955,096 on Jun. 7, 2011.

U.S. Notice of Allowance Mailed on Jan. 25, 2011 for U.S. Appl. No. 12/685,656, filed Jan. 11, 2010 which was issued as U.S. Patent No. 7,955,096 on Jun. 7, 2011.

U.S. Notice of Allowance Mailed on Feb. 22, 2011 for U.S. Appl. No. 12/685,656, filed Jan. 11, 2010 which was issued as U.S. Patent No. 7,955,096 on Jun. 7, 2011.

U.S. Notice of Allowance Mailed on Apr. 28, 2011 for U.S. Appl. No. 12/685,656, filed Jan. 11, 2010 which was Issued as U.S. Patent No. 7,955,096 on Jun. 7, 2011.

U.S. Notice of Allowance Mailed on Sep. 26, 2011 for U.S. Appl. No. 12/689,163, filed Jan. 18, 2010.

Office Action in U.S. Appl. No. 13/194,898 Dated Mar. 27, 2012.

A Final Office Action issued on Jul. 19, 2012 for U.S. Appl. 13/194,898, filed Jul. 29, 2011. 12 pages.

* cited by examiner

FIG. 3A
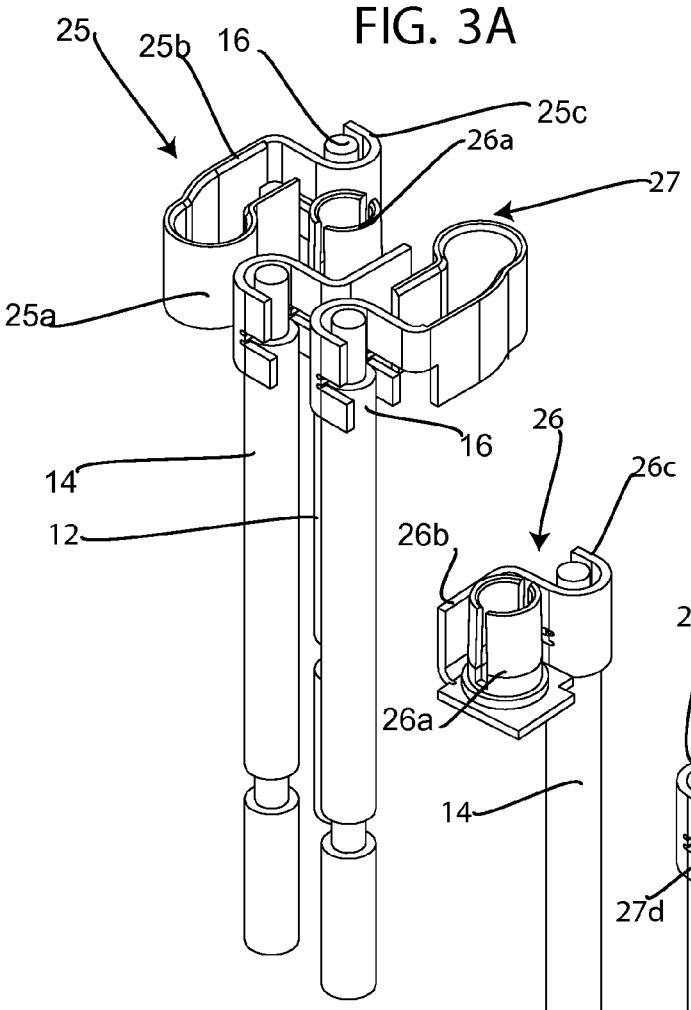
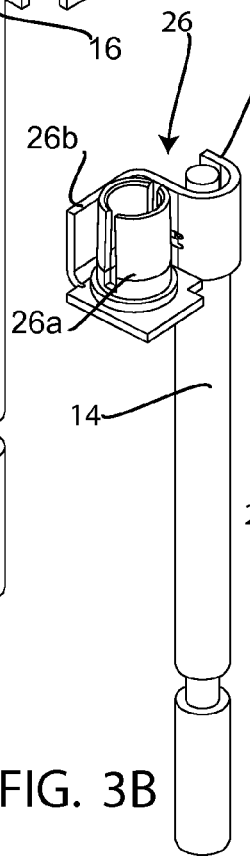
FIG. 3B
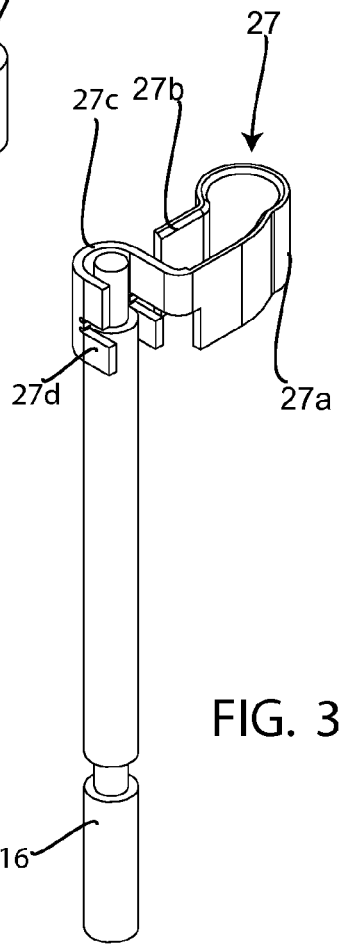
FIG. 3C

MODULAR WIRING SYSTEM WITH LOCKING ELEMENTS

CROSS REFERENCE TO RELATED APPLICATIONS

This application is a continuation application of U.S. application Ser. No. 12/685,656 filed on Jan. 11, 2010, the disclosure of which is hereby incorporated herein by reference in its entirety.

BACKGROUND

One embodiment relates to a modular wiring system having locking elements. The wiring system comprises a wiring unit or module and a functional unit or functional module. The wiring unit can be for coupling to the ends of wires such as a phase wire, a neutral wire and a ground wire. The functional module can be for example in the form of a receptacle or a light switch. Other types of modular units are known in the art, for example, U.S. Pat. No. 7,052,313 to Gorman, which issued on May 30, 2006, the disclosure of which is hereby incorporated herein by reference in its entirety.

SUMMARY

One embodiment of the invention relates to a modular wiring system comprising a functional unit and a wiring unit. There is also a system for coupling the functional unit to the wiring unit in a rotational manner. This system can be formed from at least one locking element or prong comprised of electrically conductive material. The prong can also be known as a branch, arm, fin, projection, post, or rod depending on its shape. When the functional unit is coupled to the wiring unit, the locking element or prong is both electrically and physically coupled to the functional unit at a first end and to the wiring unit at a second end. Alternatively, or in addition, the system for coupling the functional unit to the wiring unit in a rotational manner can include at least one flange coupled to the functional unit and at least one flange coupled to the wiring unit. These flanges operate such that when the functional unit and the wiring unit are placed together, they are rotated to form a locking connection between the flange on the functional unit and the flange on the wiring unit.

An example or first embodiment of the invention can include a functional unit comprising a housing, at least one functional interface coupled to the housing, and at least one locking element or prong extending out from the housing. This locking element or prong has a first section forming a base connection section and a second section forming a locking section.

The wiring unit comprises a housing having at least one opening and at least one front face forming a connection interface for the locking section of the locking element or prong.

In one embodiment, this locking element or prong can be in the form of a substantially cylindrically shaped prong made from electrically conductive material. Alternatively, the locking element or prong can be in the form of a plate or curved arm made from electrically conductive material.

This locking element or prong can include a first base section that is smaller in area than the second locking section. The locking section can be in the form of a locking flange which can be used to interact with an inside region of the front face of the housing to lock the functional unit to the wiring unit.

In addition to the locking prongs, there can also be locking flanges, which can be used to couple the functional unit to the wiring unit. For example, both the functional unit and the wiring unit can comprise at least one, or multiple locking flanges, which facilitate the connection of these two units together. In this case, at least one locking flange is in the form of a fixed latch tab. Alternatively, at least one locking flange can be in the form of a latch release tab which functions as a leaf spring.

The functional unit and the wiring unit are coupled to each other in a rotational manner. To facilitate this type of connection, the functional unit further comprises at least one raised surface disposed on its back face. This raised surface is for allowing the wiring unit to couple to the locking element on the functional unit and then rotate on the raised surface.

The wiring unit can be designed such that it has at least one opening wherein the opening can be wider in a first section and then narrower in a second section. In this case, the functional unit includes a locking element prong having a narrower base and a wider end portion. With this design, the first wider receiving region is adapted to receive said wider end portion of the locking element or prong, such that when said wiring unit is put in functional contact with the functional unit, the wider end portion inserts into the wider receiving region. Next, the wiring unit is rotated relative to the functional unit such that the wider end portion on the locking prong rotates into the second narrower locking region on the wiring unit to lock the functional unit to the wiring unit. This locking function occurs when the wider end portion is disposed under the narrower region on the wiring unit and essentially locked inside of the housing of the wiring unit.

One of the numerous advantages of this type of connection system is that both the wiring unit and the functional unit are easily connectable to each other such that the functional unit and the wiring unit can be simply rotated relative to each other to move from an unlocked to a locked position, or rotated back to move from a locked to an unlocked position.

When the functional unit and the wiring unit are coupled together, the locking flanges on the wiring section rotate around and snap underneath the locking flanges on the functional unit. On the wiring unit, at least one of the flanges is in the form of a lead flange which has a curved leading edge which interacts with a flange on the functional unit which acts as a latch release tab.

The latch release tab is in the form of a movable leaf spring which can be pushed back via the rotational interaction of the curved leading edge of the lead flange on the wiring unit. The lead flange on the wiring unit also includes a locking projection in the form of a lip or flange which extends substantially perpendicular to the extension of the body of the lead flange. When the wiring unit is rotated into a locked position, this locking projection snaps past the latch release tab and then forms a rim locking the wiring unit in place. To release the wiring unit from the functional unit, the latch release tab is pulled back away from the body of the wiring unit, releasing the locking projection, which then allows the wiring unit to rotate back around and then release from the functional unit.

BRIEF DESCRIPTION OF THE DRAWINGS

Other objects and features of the present invention will become apparent from the following detailed description considered in connection with the accompanying drawings which disclose at least one embodiment of the present invention. It should be understood, however, that the drawings are designed for the purpose of illustration only and not as a definition of the limits of the invention.

In the drawings, wherein similar reference characters denote similar elements throughout the several views:

FIG. 3A is a perspective view of the interior components shown in the wiring unit shown in FIG. 2B;

FIG. 3B is a perspective view of one of the interior components in the wiring unit in FIG. 2B;

FIG. 3C is a perspective view of another one of the interior components shown in FIG. 3A;

DETAILED DESCRIPTION

Figure 1:
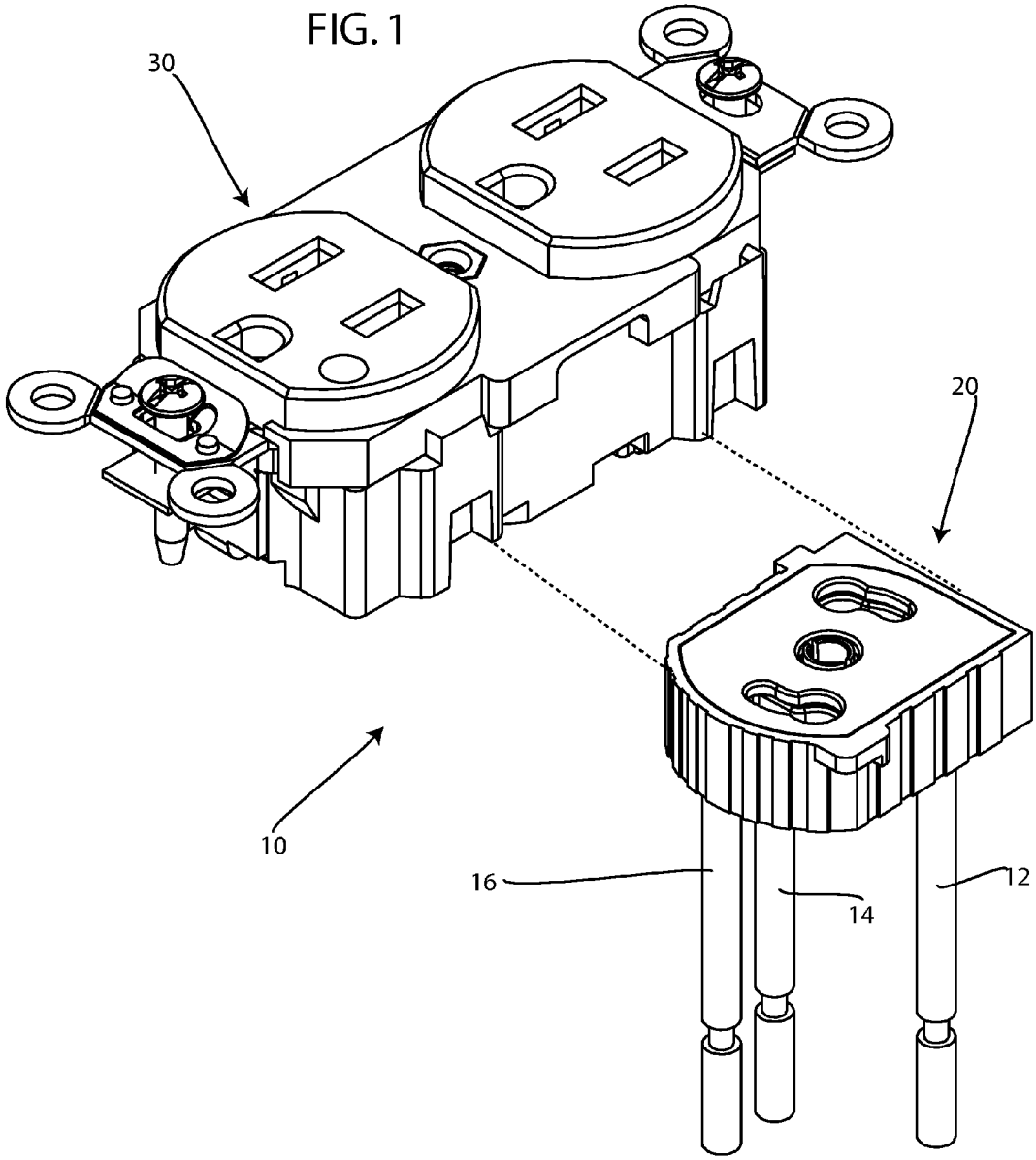
FIG. 1 is a perspective view of a first embodiment of the device including a wiring unit and a functional unit.

Referring to the drawings, FIG. 1 is a front perspective view of a first embodiment of a device 10 comprising a wiring module or unit 20, and a functional module or unit 30. Wiring module or unit 20 is coupled to wires 12, 14, and 16. In this example, wire 12 is a first, hot or phase line, serving as a power input line, wire 14 is a ground line, while wire 16 is a second, return path or neutral line.

Figure 2A:
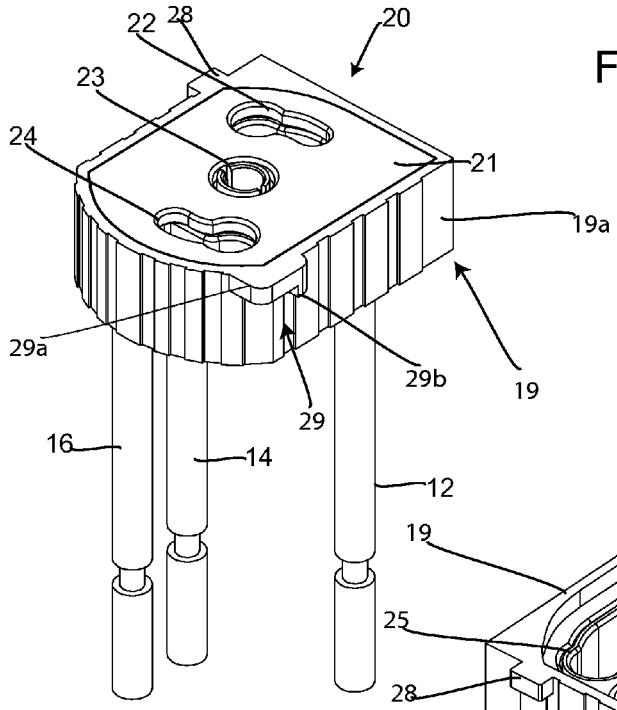
FIG. 2A is a front perspective view of a first embodiment of the wiring unit.

FIG. 2A is a front perspective view of wiring or connecting module or unit 20 which can be coupled to functional module or unit 30 as shown in FIG. 1. In this view, there is shown a body 19 having a perimeter region 19*a*, a front face 21 and functional interactive elements 22, 23 and 24. Opposite functional face 21 are three wires 12, 14 and 16 which pass through the back end of wiring or connecting unit 20. There are also tabs or flanges 28 and 29 which are coupled to base body 19 (see FIG. 4A). These tabs or flanges 28 and 29 are disposed in opposite corners from each other and are used to assist in locking the wiring unit to the functional unit. Flange 28 is in the form of a substantially rectangular flange, while flange 29 is a lead flange and includes a body section 29*a* and a locking projection 29*b* which extends substantially perpendicular to the body section 29*a*.

Figure 2B:
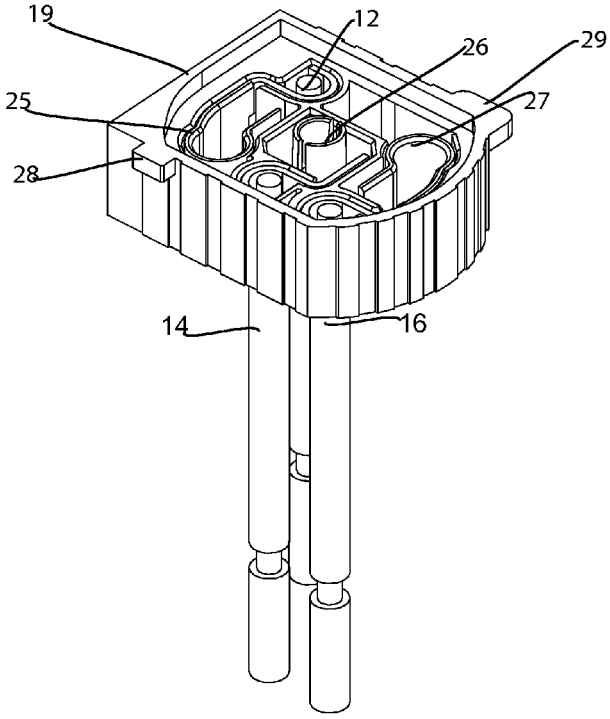
FIG. 2B is a front perspective view of an open face on the wiring unit.

FIG. 2B discloses a front perspective open view of wiring unit 20. In this view, there is shown a central shaft 26 disposed inside of body 19 for receiving a ground pin. In addition, there is also shown wiring connectors 25 and 27 which are disposed in body 19 and are each respectively coupled to hot wire 12 and neutral wire 16. In addition, central shaft 26 is electrically coupled to ground wire 14.

FIGS. 3A-C disclose wiring connectors 25, 26 and 27. For example, wiring connector 25 is for connecting to wire 12, while wiring connector 27 is for connecting to wire 16 while wiring connector 26 is for connecting to wire 14. Wiring connector 25 includes a body section 25*a* and a narrower connecting region or locking region 25*b*. There is also a wire contact region 25*c* and a wire insulation connection region 25*d* (not shown). Body section 25*a* is a rounded region for receiving a locking device; in this case a connecting prong or a locking pin would insert into an open wider body section 25*a* and rotate down into a narrower or smaller locking region 25*b*. Wire contact region 25*c* can be crimped onto an open exposed wire such as a phase wire, which allows electrical current to flow through. The wire insulation connection region can be used crimp on to the insulated part of the wire.

In addition, there is also a corresponding wire connector 27 which includes a body section 27*a*, a locking region 27*b*, wire contact region 27*c*, and a wire insulation connection region 27*d*. Body section 27*a* includes a wider rounded region for receiving any form of a locking device. In this case the locking device would be a locking pin, which would insert into body section 27*a* and then rotate down into a narrower or smaller locking region 27*b*. In addition, wire contact region 27*c* can be crimped onto an open exposed wire such as wire 16. In addition, a wire insulation connection region 27*d* can be crimped onto the body of the shielded part of the wire as well.

There is also shown wiring connector 26, which includes a body section 26*a* for receiving a ground pin. There is also a terminal section 26*b* and a wire connection section 26*c* which can be crimped onto a wire such as a ground wire 14. These three wire connectors 25, 26, and 27 can be made from an electrically conductive material such as a metal.

Figure 4A:
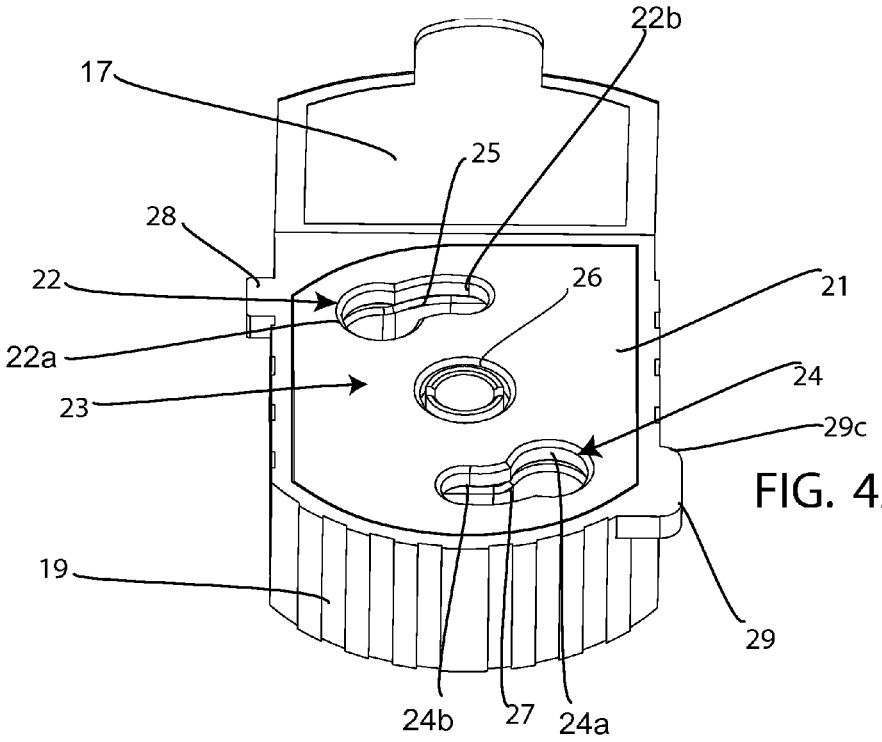
FIG. 4A is a perspective view of another embodiment of the wiring unit.
Figure 4B:
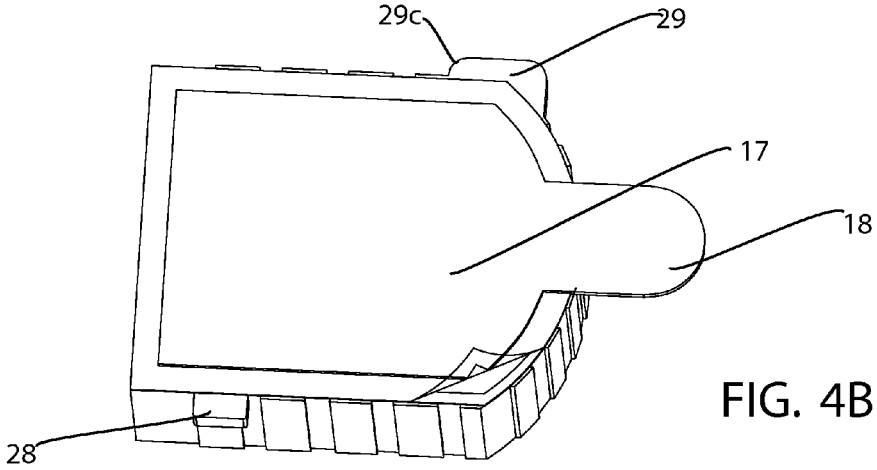
FIG. 4B is a perspective view of the embodiment shown in FIG. 4A with the cover closed.

FIG. 4A discloses a front perspective view of wiring unit 20 which includes base or body 19 front face 21 and functional interfaces 22, 23 and 24. In this case, there is shown a functional interface 22 having a receiving region 22*a* and a locking region 22*b*. In addition, functional interface 24 has a receiving region 24*a* and locking region 24*b*. These regions correspond with the respective body wiring connector section 25*a* and locking region 25*b* and body section 27*a* and locking region 27*b* (See FIG. 3A). There is also a removable cover 17 which can be made from a film type material having an adhesive for allowing the selective removal of this cover. As shown in FIG. 4B, removable cover 17 includes a tab 18, which allows a user to grip and remove cover 17. Cover 17 may optionally contain a region which may allow for preprinting or manual writing for identification purposes such as circuit or other identification. FIGS. 4A and 4B both show flanges 28 and 29 wherein flange 29 is shown as having a curved leading edge 29*c*.

Figure 5A:
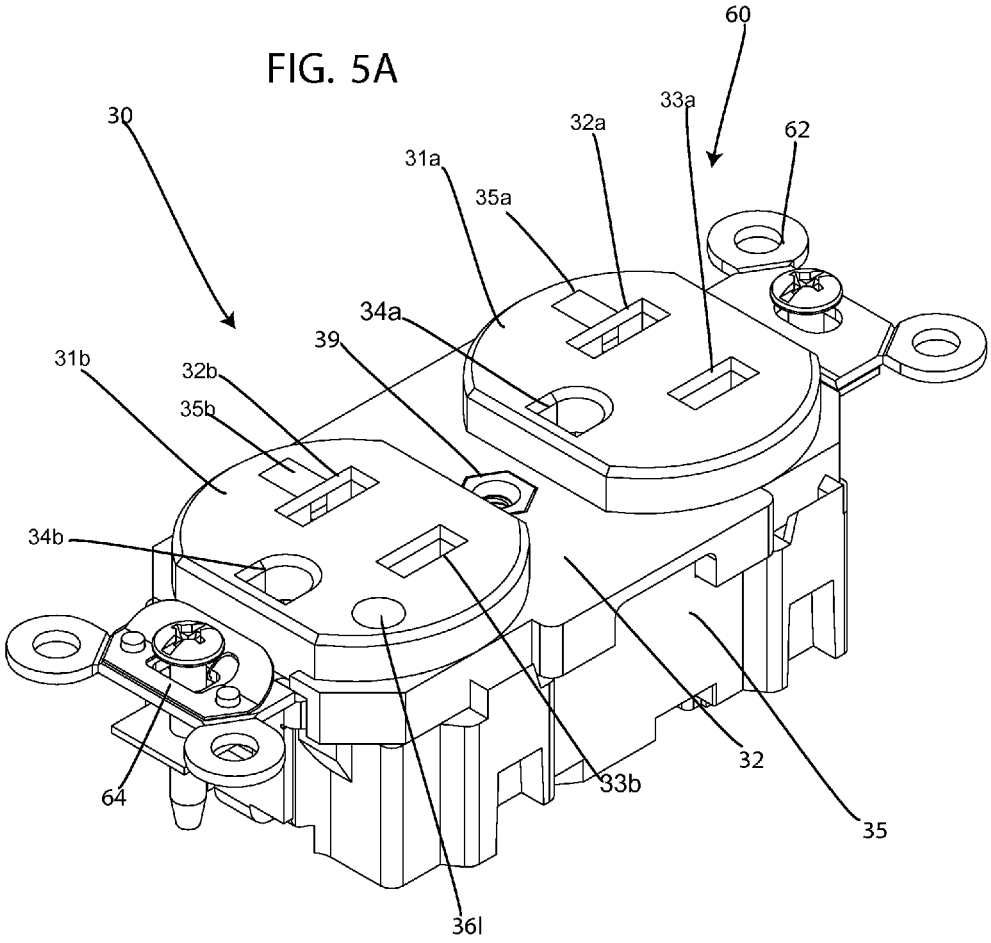
FIG. 5A is a front perspective view of the functional unit shown in FIG. 1.

As shown in FIG. 5A, there is a functional unit or receptacle 30 which includes a housing including a front face plate 32, and a body section 35. There is also a strap 60 including strap elements 62 and 64 extending out from both ends of the housing. Front face plate 32 includes plug blade openings 32*a*, 33*a* and ground pin opening 34*a* in a first outlet 31*a*. Blade opening 32*a* can also be designed to include an additional optional slot 35*a*. In addition, there are also prong openings 32*b*, 33*b* and also ground pin opening 34*b* in second outlet 31*b*. Blade opening 32*b* can also be designed to include optional slot 35*b*. Disposed in second receptacle 31*b* can be a LED light indicator 361, which can be used to indicate whether the wiring unit 20 is connected to the functional unit 30. There is also a fastener 39 for securing front plate 32 to base housing 35. Either one of these user accessible interfaces 31*a* or 31*b* can receive a standard plug.

Figure 5B:
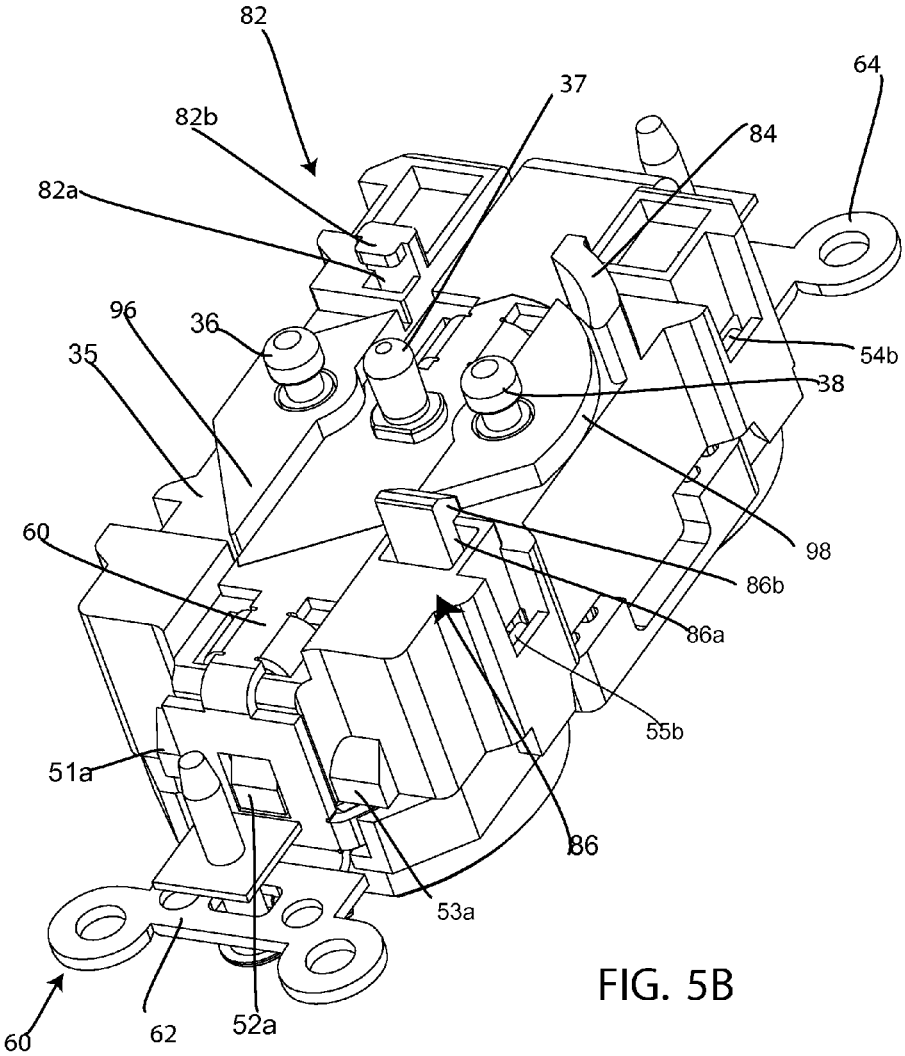
FIG. 5B is a back perspective view of the functional unit shown in FIG. 5A.

FIG. 5B shows a back view of this receptacle unit 30, wherein this receptacle unit is also shown in FIG. 5A. For example in this view there is shown the back end view of body 35 which includes raised connection sections 96 and 98 which can be used to allow the front face of wiring unit 20 to slide and rotate across the outer surfaces of body 35. Also, raised connection sections 96 and 98 provide the user with a visual indication of how to orient the wiring unit 20 for proper connection to the functional unit 30. The outer edges of raised connection sections 96 and 98, along with lines on the back surface of the strap 60 form the approximate shape of the wiring unit 20 in the correct orientation for connecting to functional unit 30. In addition, these sections include gaps disposed between a plurality of connection brackets 82, 84, and 86. First connection bracket 82 is in the form of an L-shaped connection bracket or locking flange, which includes a first extending component 82*a* extending out from the back face of body 35. The second extending component 82*b* is in the form of an overhang, which extends in a position substantially perpendicular to the first extending portion and extends parallel to an approximate plane formed by the back face of body 35. This first connection bracket acts as a fixed latch tab, which is formed integral with body 35 and is used to couple or lock down a corresponding flange 28 on wiring unit 20.

Second connection bracket 84 is in the form of a curved connection bracket which is disposed adjacent to connection section 98. This portion is curved to facilitate or guide the rotation of a side body section 19 of wiring module 20 once the wiring module 20 is in its initial coupling position with functional unit 30. Additionally, this connection bracket 84 is also in the form of a rejection post which is used to key the wiring unit to the proper polarity. With this rejection post, a user could not connect the wiring unit 20 to a functional unit with reverse polarity because if a user tried to insert the wiring unit 20 in an improper manner, it would hit or interact with rejection post 84 before properly connecting to the functional unit 30.

Third connection bracket 86 is also in the form of a locking flange and includes a first extending section 86*a* which extends out from the back face of the base 35 and an overhang or hook 86*b* which extends out substantially perpendicular to this first extending section 86*a*. This connection bracket 86 functions as a latch release tab and which is movable laterally to receive the associated rotating flange 29 on the wiring unit 20.

This view also shows strap 60 having end 62 and 64 and also connection elements 51*a*, 52*a*, 53*a*, 54*b* and 55*b* for coupling base 35 to face 32. There are also connection elements or prongs 36, 37 and 38, which can be used to allow functional unit 30 to connect to wiring unit 20.

Figure 5C:
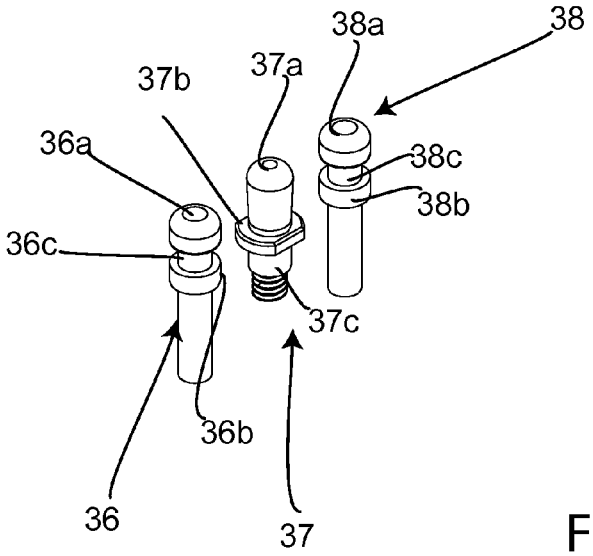
FIG. 5C is a perspective view of the connecting prongs shown in FIG. 5B.

FIG. 5C shows a perspective view of the connecting prongs or locking pins 36, 37 and 38. Locking pin 36 includes a first bulb section 36*a*, a second annular ring section 36*b* and a base section 36*c* which extends on both sides of ring section 36*b*. In addition, locking pin 38 includes a bulb section 38*a*, an annular ring section 38*b* and a base section 38*c* which extends on both sides of ring section 38*b*. Essentially, bulb sections 36*a*, and 38*a* each along with ring sections 36*b*, and 38*b* respectively form a channel in base sections 36*c* and 38*c* disposed between the sections.

When bulb sections 36*a* and 38*a* are inserted into a wiring unit, bulb sections 36*a* and 38*a* engage initial openings 22*a* and 24*a* respectively (See FIG. 4A). Once these bulb sections 36*a* and 38*a*, respectively have been inserted into the body of wiring unit 20, wiring unit 20 can then be rotated. Upon the occurrence of this rotation, these connection pins or prongs 36 and 38 rotate within these channels such that bulbs 36*a* and 38*a* slide underneath the narrower sections 22*b* and 24*b* and also inside narrower channels 25*b* and 27*b* shown in FIGS. 3A and 3C. Rotation of the wiring unit clockwise with respect to functional unit locks the wiring unit to the functional unit.

Once the two units are locked together, a counterclockwise rotation will unlock the two units (if the latch release is activated) and allow for their separation. The direction of rotation to lock or unlock the two units is intuitive to the end-user as a clockwise rotation is generally recognized as turning a device ON and counterclockwise is generally recognized turning a device OFF (such as with a valve, tightening a fastener, or assembling locking electrical connectors commonly used in the electrical industry).

Once this rotation has been completed, these prongs are locked therein such that bulbs 36*a* and 38*a* are now disposed underneath front faceplate 21, inside the narrower channels 22*b* and 24*b*. In addition, upon this rotation, locking flanges 28 and 29 connect or interact with locking flanges 82, 84, and 86 to lock wiring unit 20 to functional unit 30. Locking flange 82 is in the form of a fixed latch tab, while locking flange 86 is in the form of a latch release tab that acts as a leaf spring. For example, in this way, locking flanges 28 and 29, which form extensions extending out from body 19 slide underneath laterally extending regions 82*b* and 86*b*. Because locking flange 86 is in the form of a latch release tab, once a leading edge 29*c* of locking flange 29 contacts latch release tab 86 it drives or snaps latch release tab 86 back allowing latch 29 to pass underneath this locking flange 86. Locking projection 29*b* on locking flange 29 has an inside face that is now in contact with an inside face 86*c* (See FIG. 6A) of locking flange 86 locking the wiring unit 20 against rotation. Once these flanges 28 and 29 slide underneath these overhangs, and once bulbs 36*a* and 38*a* are locked inside of housing 19, the wiring unit 20 is then locked to functional unit 30 in a secure manner. This is because overhangs 82*b* and 86*b* lock into locking flanges 28 and 29 and keep wiring module 20 locked into functional unit 30.

To unlock wiring unit 20 from functional unit 30, a user can then pull back on locking flange 86 and then rotate wiring unit 20 in a counter clockwise manner allowing locking flange 29 to pass underneath overhang 86*b* and rotate into a releasable position.

Figure 6A:
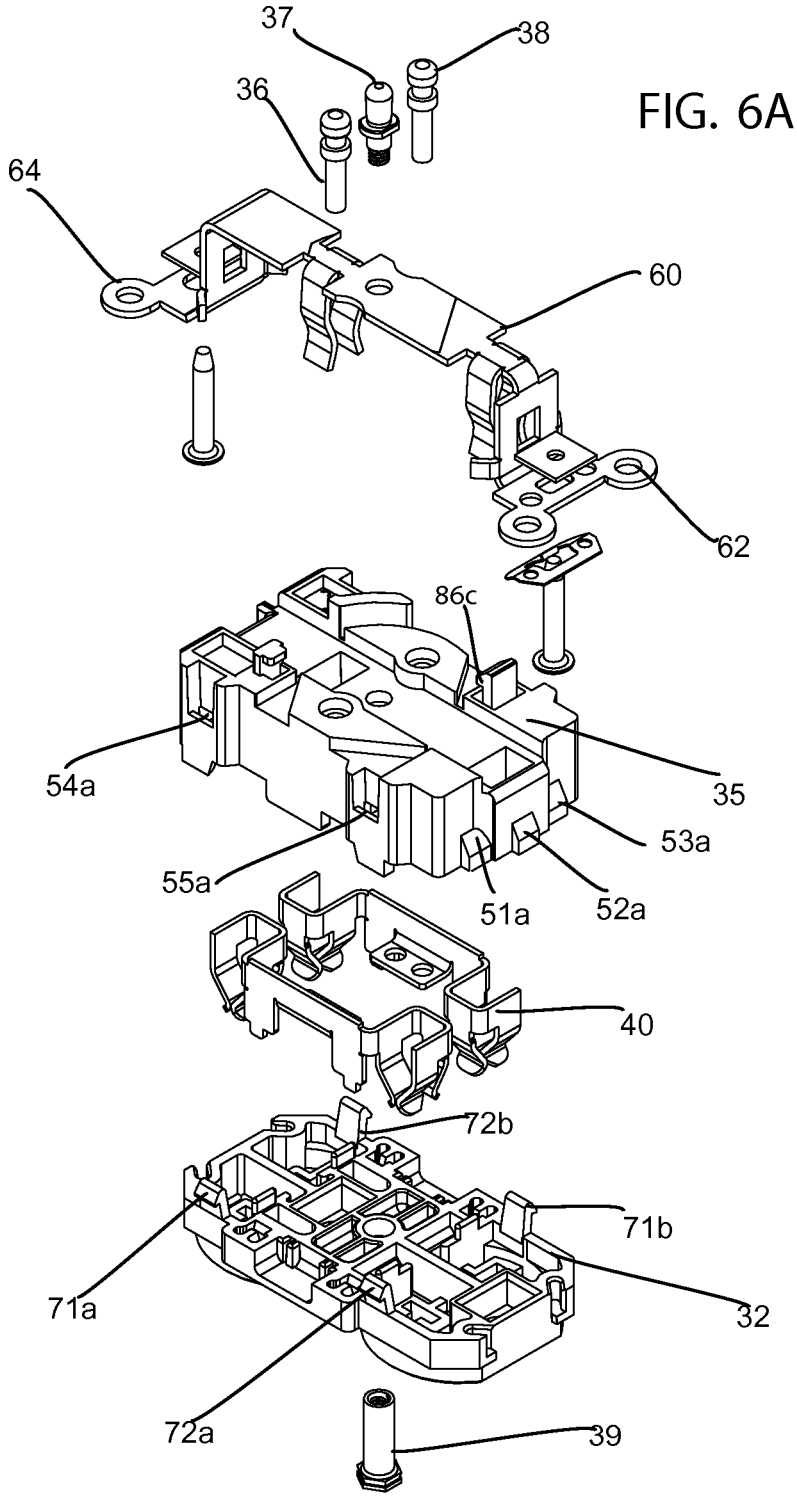
FIG. 6A is a back perspective exploded view of the functional unit.
Figure 6B:
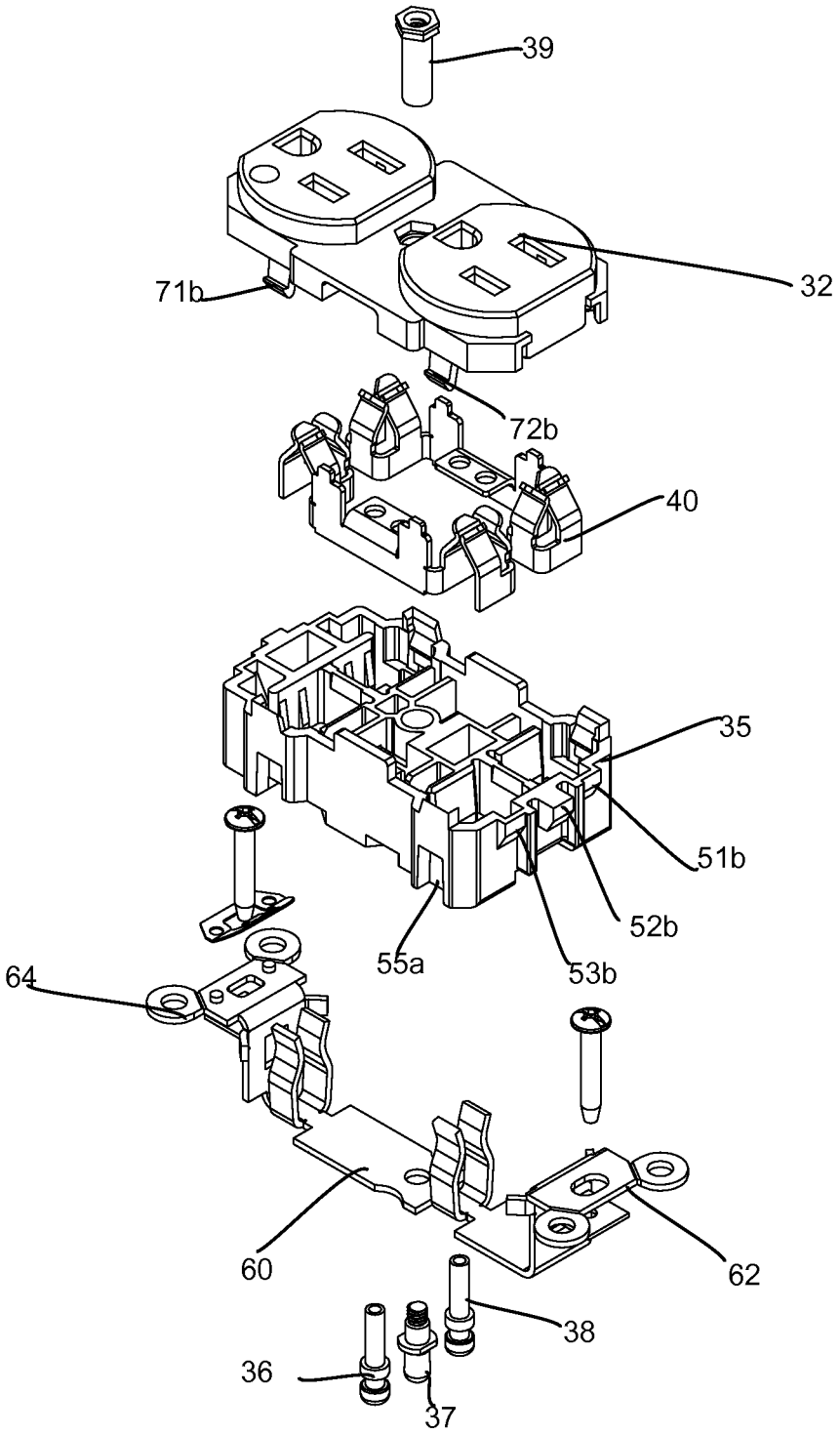
FIG. 6B is a front perspective exploded view of the functional unit shown in FIG. 6A.

FIGS. 6A and 6B disclose a back perspective exploded view and a front perspective exploded view respectively of a functional unit which is the same or similar to that shown in the first embodiment. In both of these views, there is shown a front face plate 32 which is connected to base or housing block 35. Receptacle contacts 40 are disposed between front plate 32 and base block 35. Strap 60 is coupled to a back of base block or base housing 35.

There are a plurality of connecting prongs, or pins 36, 37, and 38. Connection pins 36 and 38 are respectively for making connection to a phase and a neutral of the electrical supply. Connection pin 37 is for connecting to a ground. Base housing block 35 includes flange or end connection elements 51*a*, 52*a*, and 53*a*. In addition, there are also opposite side or also flange or end connection elements 51*b*, 52*b*, and 53*b*. There are also side connection elements 54*a* and 55*a* shown in FIG. 6A and also side connection elements 54*b* and 55*b* (See FIG. 5B).

Front face plate 32 includes side connection clips 71*a*, 72*a* and oppositely spaced connection clips 71*b* and 72*b*. These connection clips are adapted to interact with side flange elements 54*a* and 55*a* on a first side and 54*b* and 55*b* on the opposite side (See FIG. 5B).

Thus, when front face plate 32 snaps down on base housing block 35 these clips snap into the side flanges, thereby locking contacts 40 inside of the housing. FIG. 5A discloses the perspective view of functional unit 30, which has been assembled in its final condition. In addition, FIG. 5B discloses a back perspective view of the device in assembled condition.

Figure 7:
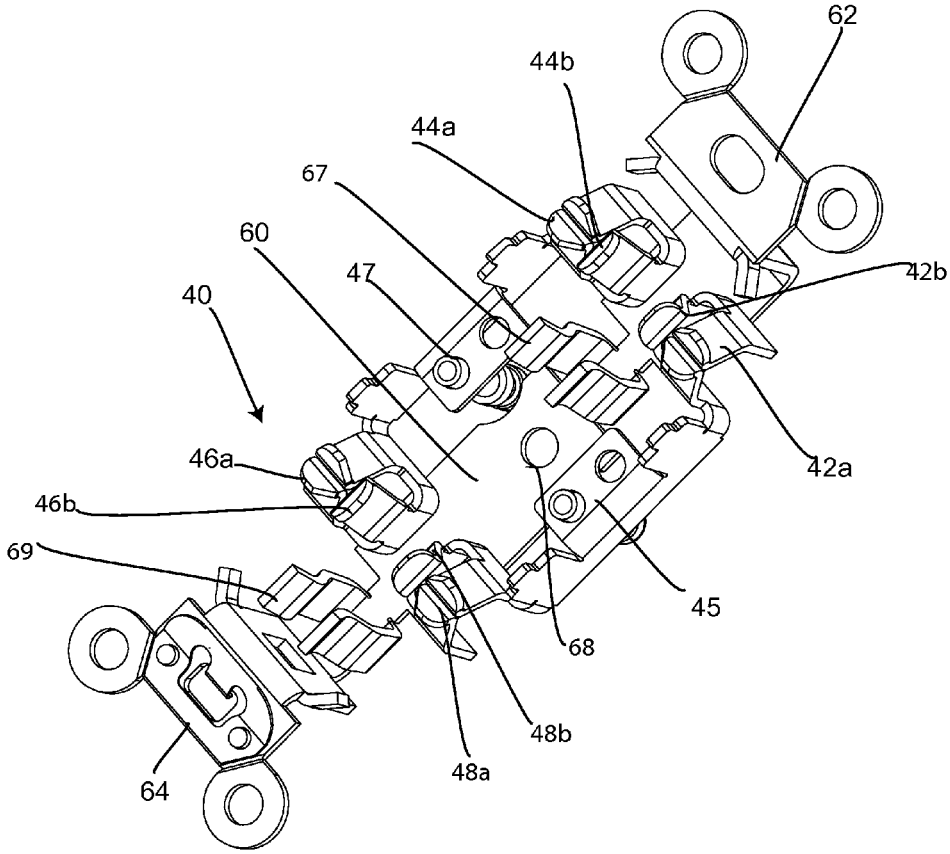
FIG. 7 is a front view of the strap and additional components shown in FIG. 6A and FIG. 6B.

FIG. 7 discloses a front perspective view of contacts 40 and strap 60 of functional unit 30. Contacts 40 can be in the form of an electrically conducting material. Contacts 40 include prong interfaces 42*a*, 44*a*, 46*a*, and 48*a*, and side prong interfaces 42*b*, 44*b*, 46*b*, and 48*b*. These prong interfaces are for receiving prongs from an electrical device such as a plug. In addition, contacts 40 are also connected to, or formed continuous with prongs or connecting elements 36 and 38 (not shown). Contacts 40 can be disposed at least partially inside of a base housing 35 which is made of a electrically insulating material such as a thermoset or a thermoplastic compound. Base housing 35 is coupled to front face plate 32, on a front end, and is coupled on a back end to strap 60. One example of a strap is strap 60 which includes strap extensions 62 and 64. In addition, strap 60 also includes strap prongs 67 and 69 for connecting into openings in body 35. Strap 60 also includes a hole 68 for receiving a ground connection pin 37, which extends out to a back end of strap 60. Connection pin 37 threads into female threads within fastener 39 (See FIG. 6A or 6B) to establish a ground path and also to aid in securing the functional unit together.

Figure 8B:
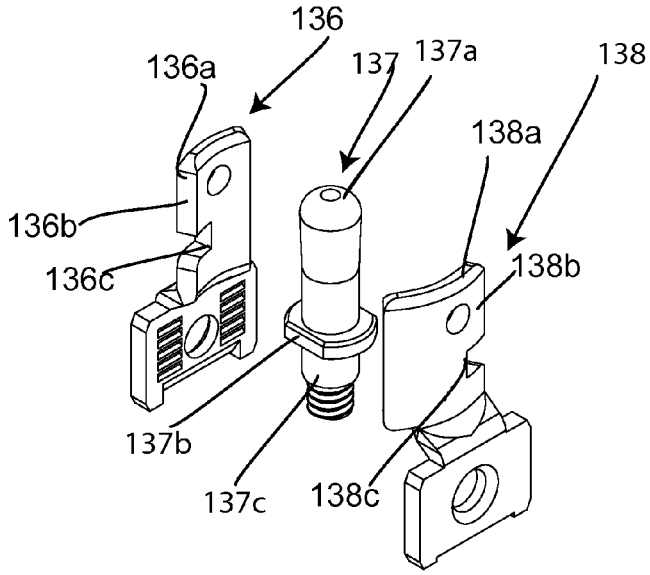
FIG. 8B is a perspective view of the connecting prongs shown in FIG. 8A.
Figure 8A:
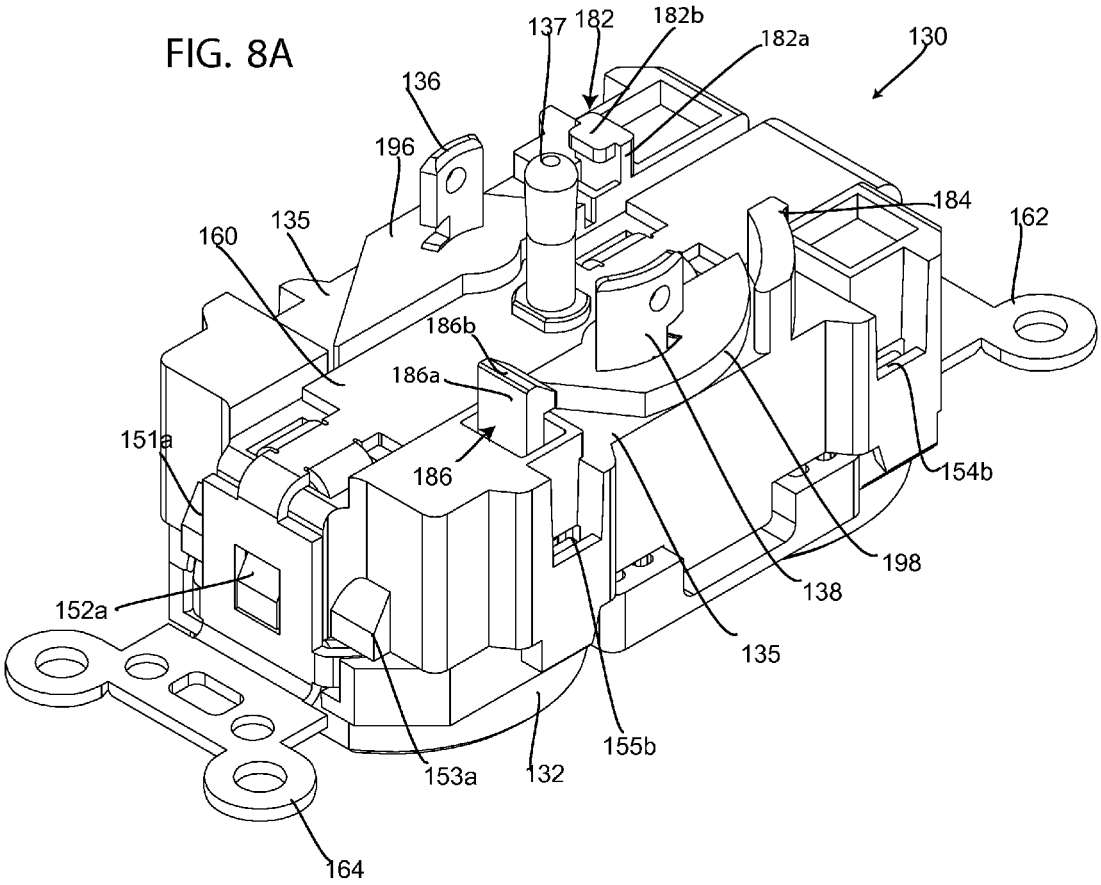
FIG. 8A is a back perspective view of a second embodiment of the functional unit.

FIG. 8A is a perspective view of a second embodiment of the invention. In this view, a second embodiment of functional unit 130 is shown. This functional unit 130 has a front face plate 132 and a body 135. There are also prongs or blades 136 and 138 which can be/are arcuate shaped and a central ground pin shaft 137 extending out from body 135. Prongs 136 and 138 are shown in greater detail in FIG. 8B. There is also a strap 160 which has strap extensions 162 and 164 extending out therefrom. This body 135 also contains a plurality of flanges which form connection elements, which can be used to allow additional elements such as a front face plate 132 or strap 160 to connect thereto. These flange elements can be in the form of snap locking element 151*a*, which locks front face plate 132 to body 135, locking elements 152*a*, and 153*a* which lock strap 160 to the body 135. In addition, there is shown locking flange 154*b*, and 155*b*, which is coupled to front face plate 132 and allows front face plate 132 to couple to body 135.

There are also locking flanges 182, 184, and 186 coupled to body 135. Locking flange 182 includes a first section 182*a*, which includes a section extending perpendicular out from a back face of body 135. There is also an overhang region 182*b*, which extends substantially perpendicular to extension element 182*a*. This locking flange is in the form of a fixed latch tab. There is also locking flange 184, which extends in a substantially circular manner around connection plate 198, which functions as a locking post to force the wiring unit to connect with proper polarity. Finally there is also another locking flange in the form of a catch or lock 186, which extends up and out from body 135 and also includes an extending section 186*a* and a catch or overhang 186*b* for catching flange 129 shown in FIG. 9. This lock or latch 186 acts as a latch release tab similar to latch release tab 86 described above.

Figure 9:
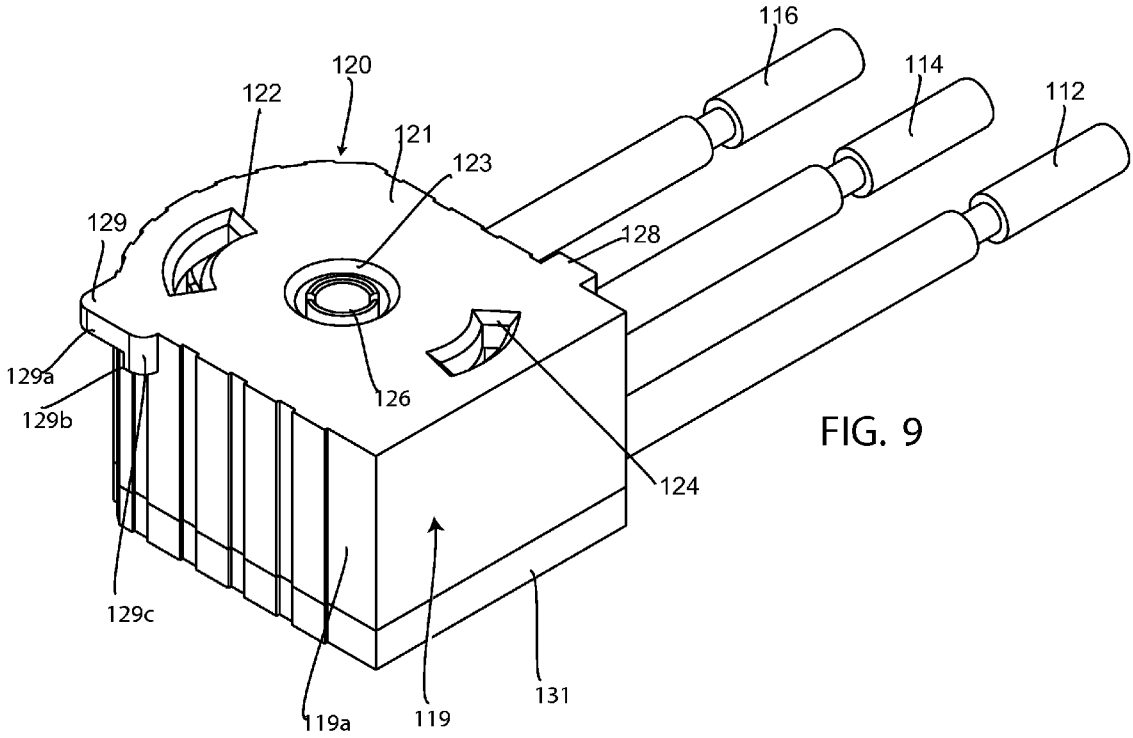
FIG. 9 is a perspective view of another embodiment of the wiring unit.

Connection surfaces 196 and 198 are designed for receiving a front face 121 of wiring unit 120 shown in FIG. 9. In this view, there are a plurality of connection wires 112, 114, and 116 which can be in the form of a hot wire 112, a ground wire 114, and a neutral wire 116. In addition, this wiring unit 120 can include a body section 119 having a perimeter region 119*a* extending around this body section and a front face 121 having a first prong opening 122, a second prong opening 124 and a ground pin opening 123. Ground pin opening 123 includes space for a cylinder 126 for receiving ground pin 137. In addition, openings 122 and 124 are designed for receiving prongs 138 and 136 respectively.

Prongs 136 and 138, which are shown in greater detail in FIG. 8B include a first section 136*a,* which is an initial contact region. A second body section 136*b* includes a hole, wherein this body section then narrows to a narrow or smaller section 136*c*. In addition, prong 138 includes an initial connection region 138*a,* the second body section 138*b* having a hole and a third narrower or smaller region 138*c*. These narrow regions 136*c* and 138*c* are designed to form catches such that when the wiring unit 120 is coupled to the back surface of housing 135, these prongs, arms, or branches 136 and 138 slide into openings 122 and 124 such that once connection element 120 is rotated, a flange (not shown but disposed inside of the housing) locks into narrower openings in regions 136*c* and 138*c* to lock these prongs therein. In this case, connection wires 112, 114, and 116 extend out from a side region so that with this design, the wiring unit does not require as much space in a wall mounted box. In addition, this side extending wiring feature can also be used with wiring unit 20 as well. When there is a side wiring configuration, the depth of the wiring unit is less as well further enhancing the space saving features of this wiring unit.

Figure 10:
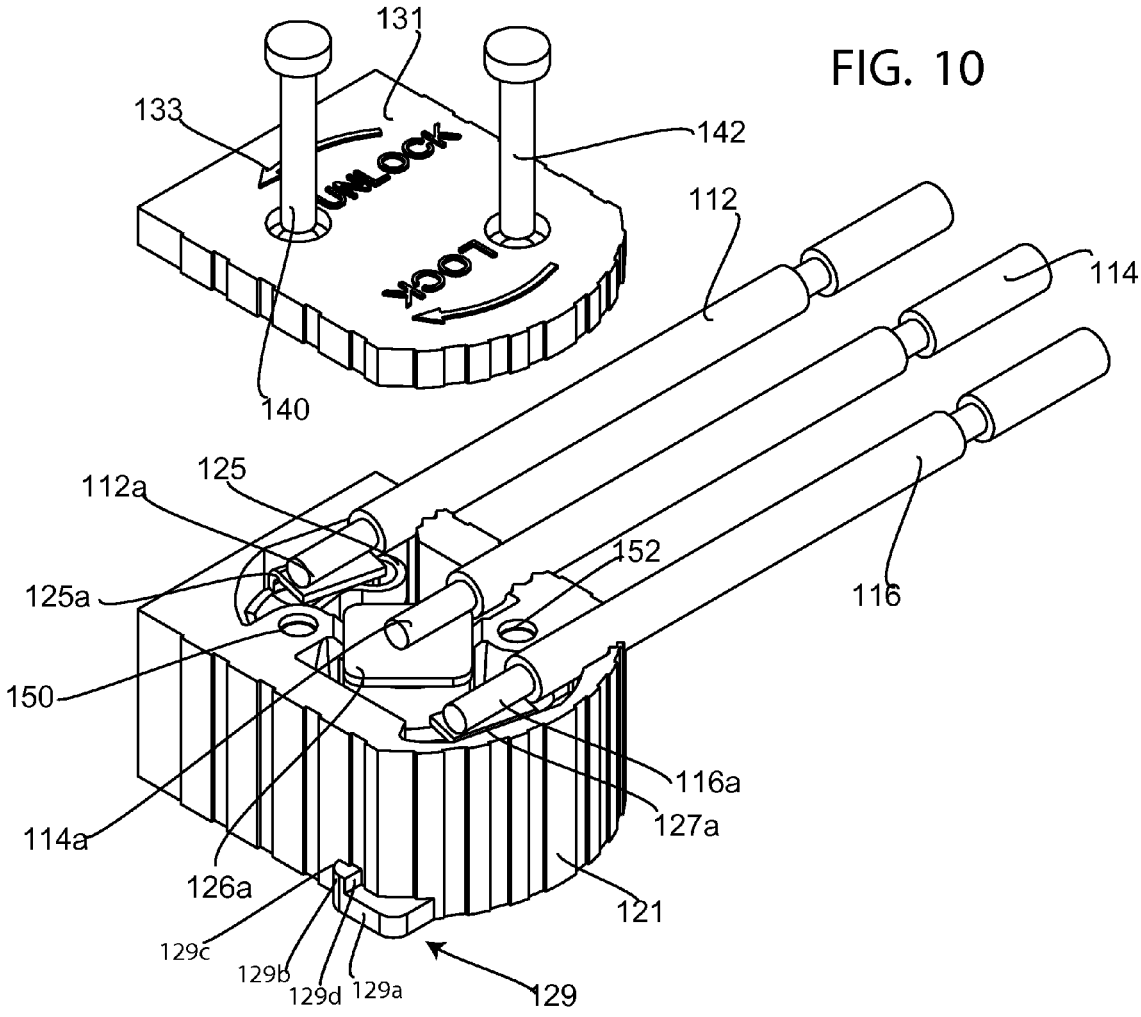
FIG. 10 is an open semi-exploded view of the wiring unit shown in FIG. 9.

FIG. 10 discloses the backside view of the embodiment shown in FIG. 9. In this view, there is shown wiring unit 120 which includes body section 121 and back plate 131 which is coupled to body section 121 via fasteners 140 and 142 which are insertable into holes 150 and 152 on body section 121. A plurality of wires 112, 114, and 116 having respective exposed ends 112*a,* 114*a,* and 116*a* are shown coupled to electrical contacts 125*a,* 126*a,* and 127*a* which lead to respective open contacts on the opposite face (See FIG. 9). Disposed on back face 131 can be writing or indicia 131 setting forth a set of instructions to a user on how to connect wiring unit 120 to functional unit 130.

When wiring unit 120 is coupled to functional unit 130, locking flanges 128 and 129 interact with locking flanges 182, 184, and 186 to form a secure connection. For example, as wiring module 120 is rotated in a clockwise manner, the leading edge 129*c* which is formed with a curved interface rotates into locking flange 186 formed as a leaf spring or latch release tab. This rotational movement drives locking flange 186 back and allows locking flange 129 underneath overhang 186*b*. In the fully rotated and locked position, locking projection 129*b* has rotated past locking flange 186 such that inside face 129*d* of locking projection 129*b* is now in contact with an inside face of locking flange 186. To unlock wiring unit or wiring module 120 from functional module 130, latch release tab or locking flange 186 is pulled back so that locking flange 129 can now pass underneath overhang 186*b* wherein as wiring module 120 continues to rotate past locking flange 186, it can then be moved into a release position so that it can be pulled away from functional module 130. Either of the wiring modules 20 or 120 may include additional labels including indicia, which can be used as instructions for connecting the wiring modules and the functional modules together. These labels can be coupled to a top section or a side surface of these wiring modules.

In addition, in each of the embodiments, the two wiring units 20 and 120 and the functional units 30 and 130 can each include rejection elements. These rejection elements can be in the form of flanges such as flanges 28 and 29, or curved connection bracket 84 and 184 which can operate as a rejection post which can be used to intersect with a perimeter of the bodies 19, and 119 of either of the wiring units 20, 120.

The designs of wiring modules 20, 120 and functional modules 30 and 130 are formed so that these devices can be both electrically and mechanically coupled together in a secure manner. In addition both of these embodiments are designed so that the wiring module and the functional module can only be coupled together in one way, so as to prevent against miswiring.

Figure 11:
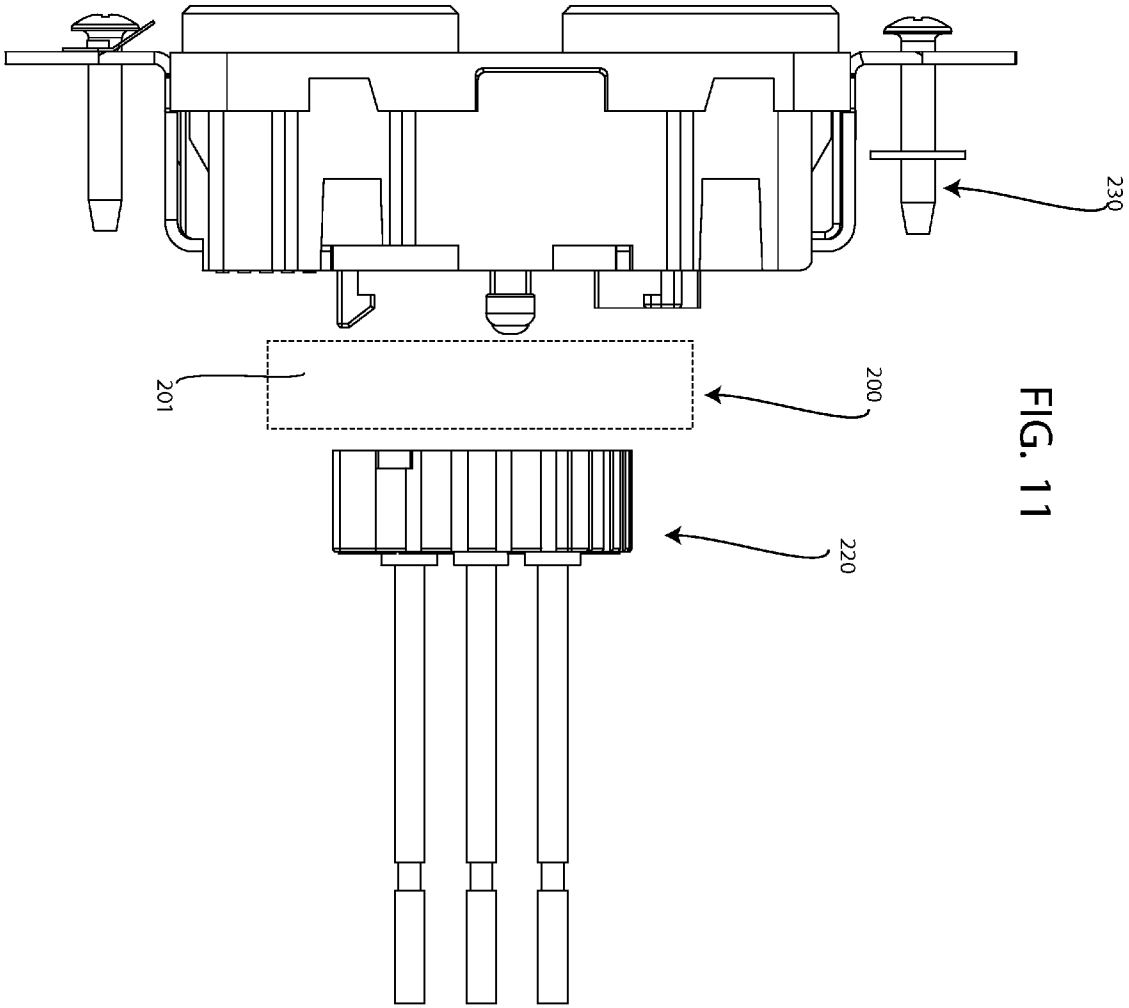
FIG. 11 is a side view of an adapter which is used to connect the functional unit with the wiring unit.

FIG. 11 is a side view of a modular wiring device which shows a functional unit 230 a wiring unit 220 and an adapter unit 200 disposed in between. This adapter unit 200 is designed to be a universal adapter to connect any wiring unit to any functional unit. Thus, the use of the adapter unit 200 allows for the connection of any type of wiring unit 220 to the functional unit 230. Adapter 200 is shown as a generic box because it can essentially be made so that it is connectable to any type of wiring unit 220 and any type of functional unit 230 as a connecting interface.

Figure 12:
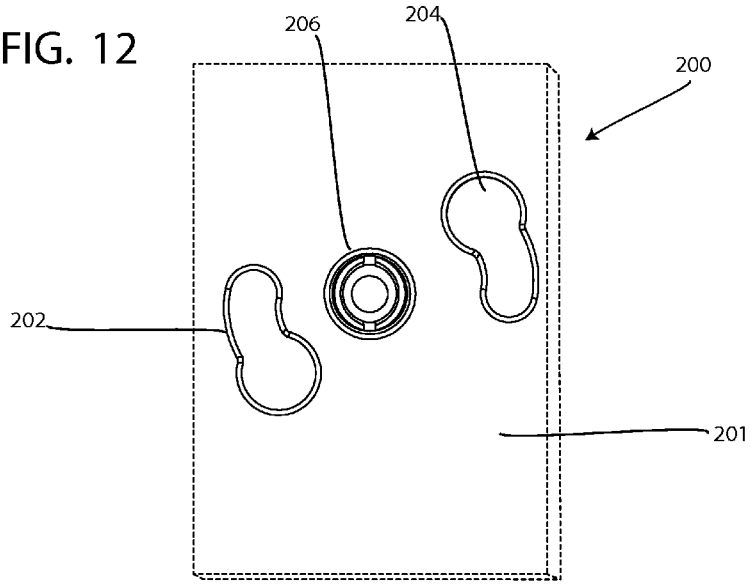
FIG. 12 is a front view of the adapter shown in FIG. 11.

One example of adapter 200 is shown in FIG. 12 which shows a front face of a body section 201 of adapter 200. This front face has holes 202, 204 and 206 for interfacing with connection elements such as prongs or connection interfaces 36, 37, and 38 (See FIG. 5B). Body section 201 is shown in dotted lines because it can be designed with any shape necessary to connect a functional unit to a wiring unit.

Figure 13:
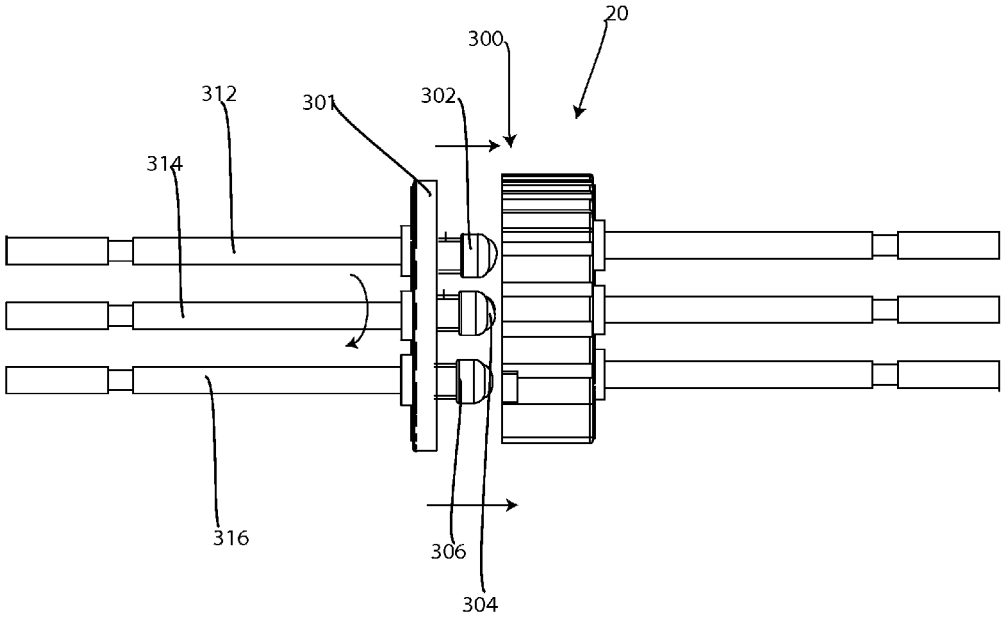
FIG. 13 is a side view of a connector which can be used to connect to a wiring unit.

FIG. 13 shows another connection element or adapter 300 which has a body section 301, and prongs 302, 304, and 306. Each of prongs 302, 304, and 306 are connected to respective wires 312, 314, and 316 wherein these wires form connection ends which can be crimped, screwed on, or attached by any known means to a functional unit, or any type of receptacle which is connectable to wires. Thus, with this type of adapter, the wiring unit can be connected either to an associated functional unit, or wired to any available receptacle.

Figure 14A:
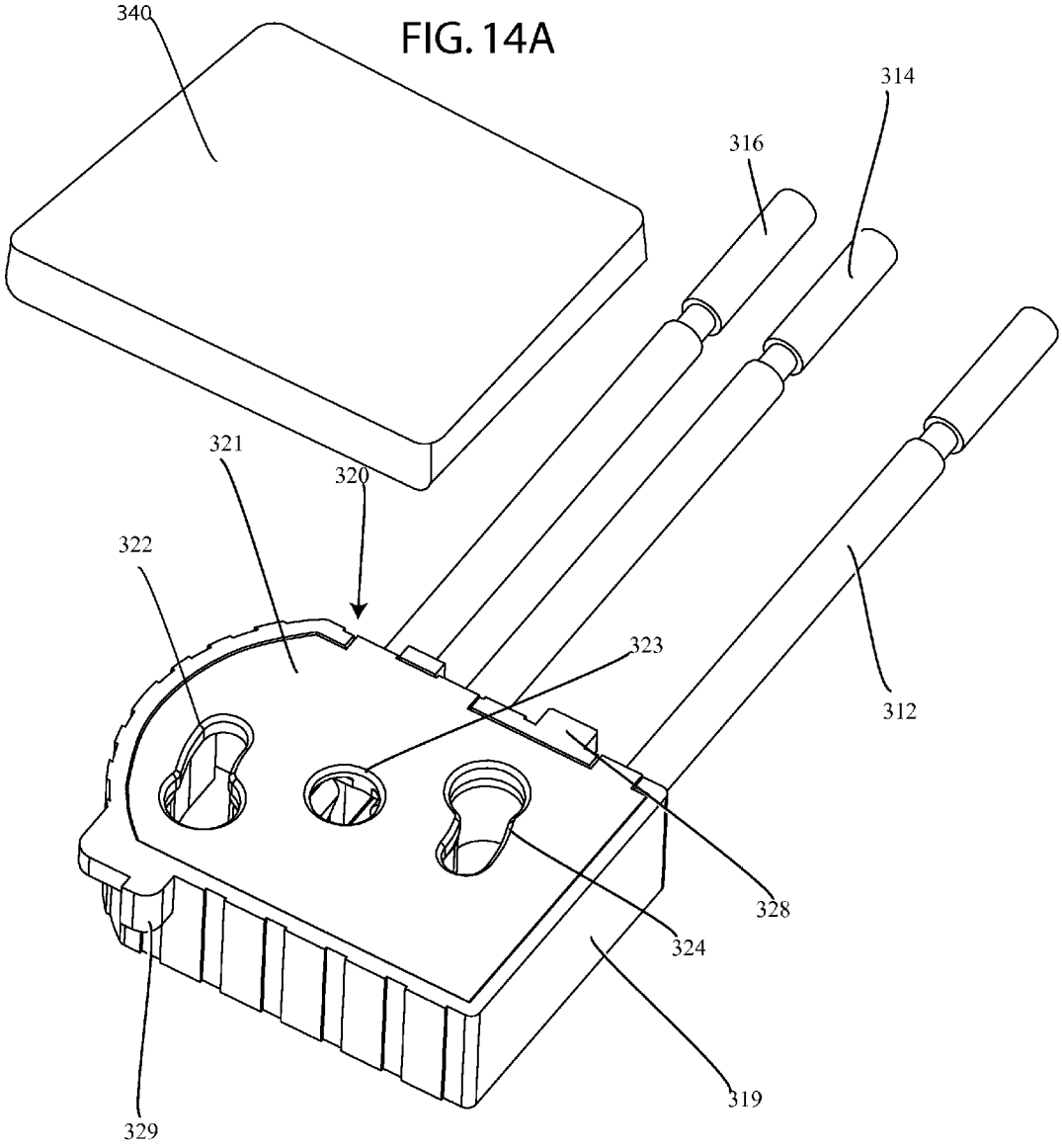
FIG. 14A is a top perspective view of another embodiment of a wiring unit.

FIG. 14A is a top perspective view of another embodiment of a wiring unit. With this embodiment, there is a wiring unit 320 which has a front face 321, with holes or openings 322, 323, and 324 for receiving prongs. Extending out from a housing 319 are wires 312, 314 and 316, wherein wire 314 is a ground wire while wires 312 and 316 are phase and neutral lines. There are also flanges 328 and 329 for locking with a corresponding functional unit. With this embodiment as well as with the embodiments shown with respect to wiring units 20 and 120, a cap 340 made from any suitable material such as plastic can be used to cover the front face of the wiring unit as well.

Figure 14B:
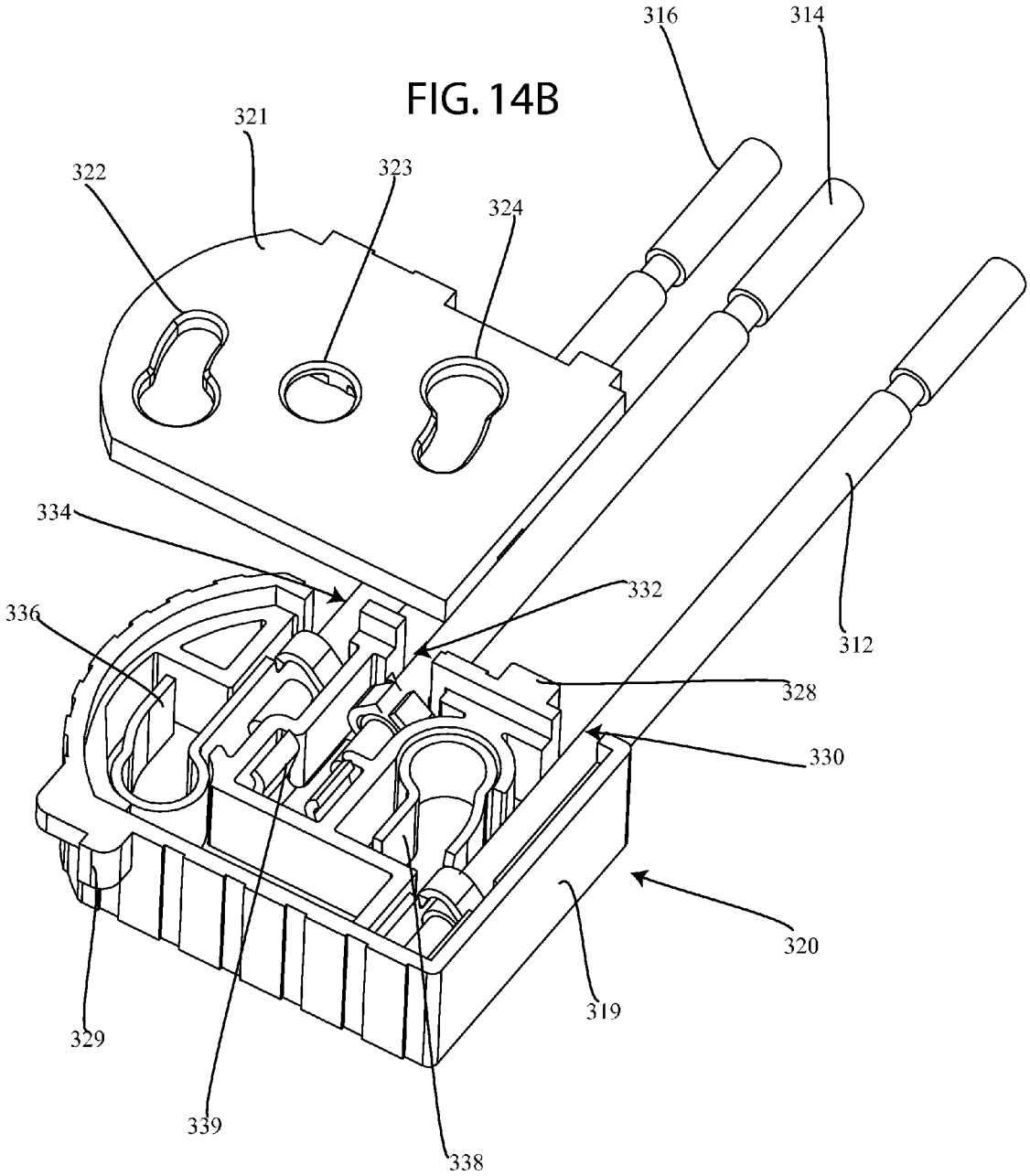
FIG. 14B is a top perspective partially exploded view of the wiring unit of FIG. 14A.

FIG. 14B is top partially exploded perspective view of the wiring unit shown in FIG. 14A. With this view, top 321 is removed from wiring unit 320 showing how wires 312, 314, and 316 enter through holes 330, 332, and 334 in housing 319. Holes 330, 332, and 334 are side entry holes which allow this design to be more compact, with the depth of housing 319 being more compact than the depth of housing 19 or 119. Contacts or terminals 336, 338, and 339 are disposed inside of housing 319 and are designed to receive associated prongs or terminal connections from a respective functional unit.

Figure 15A:
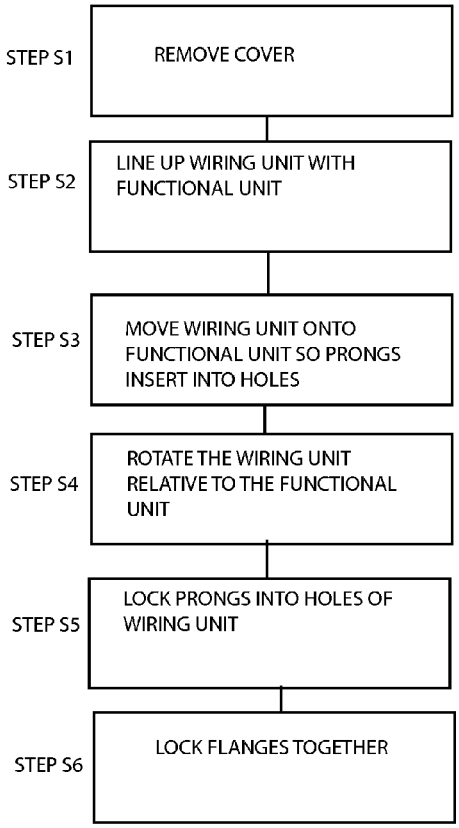
FIG. 15A is a flow chart for the process for connecting the wiring module to the functional module.
Figure 15B:
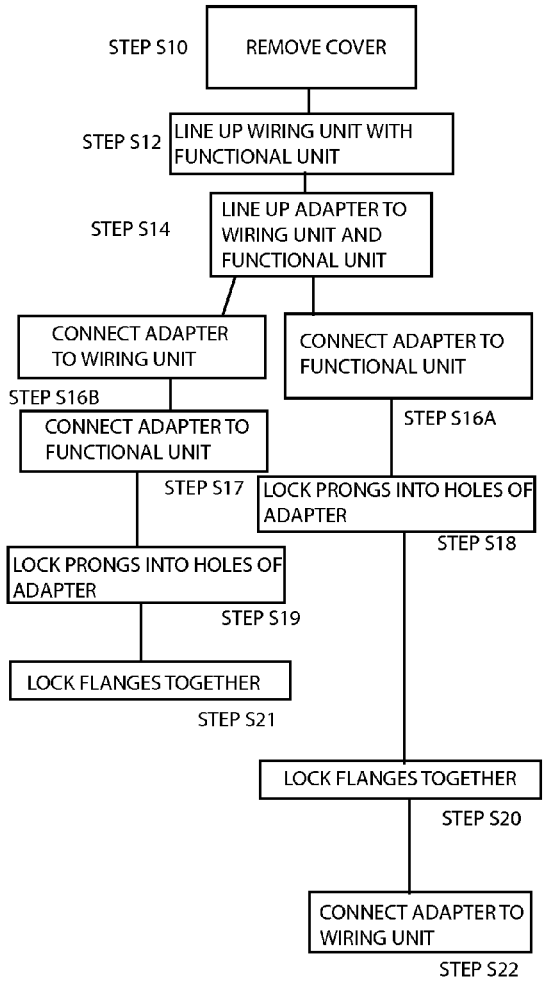
FIG. 15B is a flow chart for the process for connecting the wiring module and the functional module to the adapter.

FIG. 15A is a flow chart for a process for connecting the system including the wiring unit and the functional unit together, while FIG. 15B is a flow chart showing the process for connecting the wiring unit, the functional unit and the adapter together.

For example, FIG. 15A shows the process for connecting a wiring unit such as unit 20 or 120 to a functional unit such as unit 30 or 130 wherein if there is a cover, in step S1 a user can remove a cover from wiring unit 20 or 120. If there is no cover, then the first step is step S2. Next, in step S2 a user lines up a wiring unit with a functional unit, whereas in step S3 the user moves the wiring unit onto the functional unit so that prongs such as prongs 36, 37, and 38 or 136, 137 and 138 insert into corresponding holes 22, 23, and 24 or 122, 123, and 124. Next, in step S4 the wiring unit 20 or 120 and the functional unit 30 or 130 can be rotated relative to each other. This rotational movement can be performed by rotating both of the units, or by holding one of the units stationary while rotating one unit relative to the other unit. Next, in step S5 the prongs are locked into the associated holes wherein the flanges such as flanges 28 and 29 or 128 and 129 are locked into corresponding flanges 82, and 86 to lock the wiring unit together with the functional unit. In this way, the rotation of wiring unit 20 is such that the larger ends of prongs 36, and 38 lock into the smaller hole openings on the wiring unit, while flanges 28 and 29 or 128 and 129 lock under and into flanges 82 and 86.

FIG. 15B shows a flow chart for the process for connecting the wiring unit, the functional unit and the adapter together. With this process, if there is a cover, a user can in step S10 remove a cover as that shown in FIG. 4B. Next, in step S12, and step S14 which can occur in any order, a user lines up a wiring unit with the functional unit (step S12) and also lines up the adapter with the wiring unit and the functional unit in step S14. Next, in step 516A the adapter can be connected to the functional unit. In step S18 the prongs of the functional unit can be locked into the holes of the adapter so as to secure the adapter 200 to the functional unit. In step S20, which can occur simultaneous with the connection of the prongs, the flanges of the functional unit are connected to the adapter. Finally, in step S22 the adapter is connected to the wiring unit so that there is full electrical continuity between the wiring unit and the functional unit.

Alternatively, in step 16B, the adapter can be connected to the wiring unit. Next, in step S17, the adapter is connected to the functional unit by inserting the prongs into the holes of the adapter. Next in step S19 and in step S21 which can occur sequentially in any order or simultaneously, the prongs are locked into the holes of the adapter while the flanges on the functional unit are locked into the flanges on the adapter. While the different sequential steps are shown in FIGS. 15A and 15B, these steps can be simplified as well. For example, the step series of FIG. 15A can be simply a single step of connecting a functional unit to a wiring unit. While the step series in FIG. 15B can be two different alternative steps such as connecting a wiring unit to an adapter and then the adapter to a functional unit, or connecting a functional unit to an adapter and then the adapter to the wiring unit. These steps can occur in any order or even substantially simultaneously.

As described above, the adapter is designed to bridge the different designs between any known functional unit and any known wiring unit so that any type of wiring unit can be connected to any type of functional unit.

While multiple different embodiments have been shown above, the following different embodiments disclose alternative designs of wiring modules and functional modules, such that each different embodiment discloses only one of many different possible embodiments.

Figure 16A:
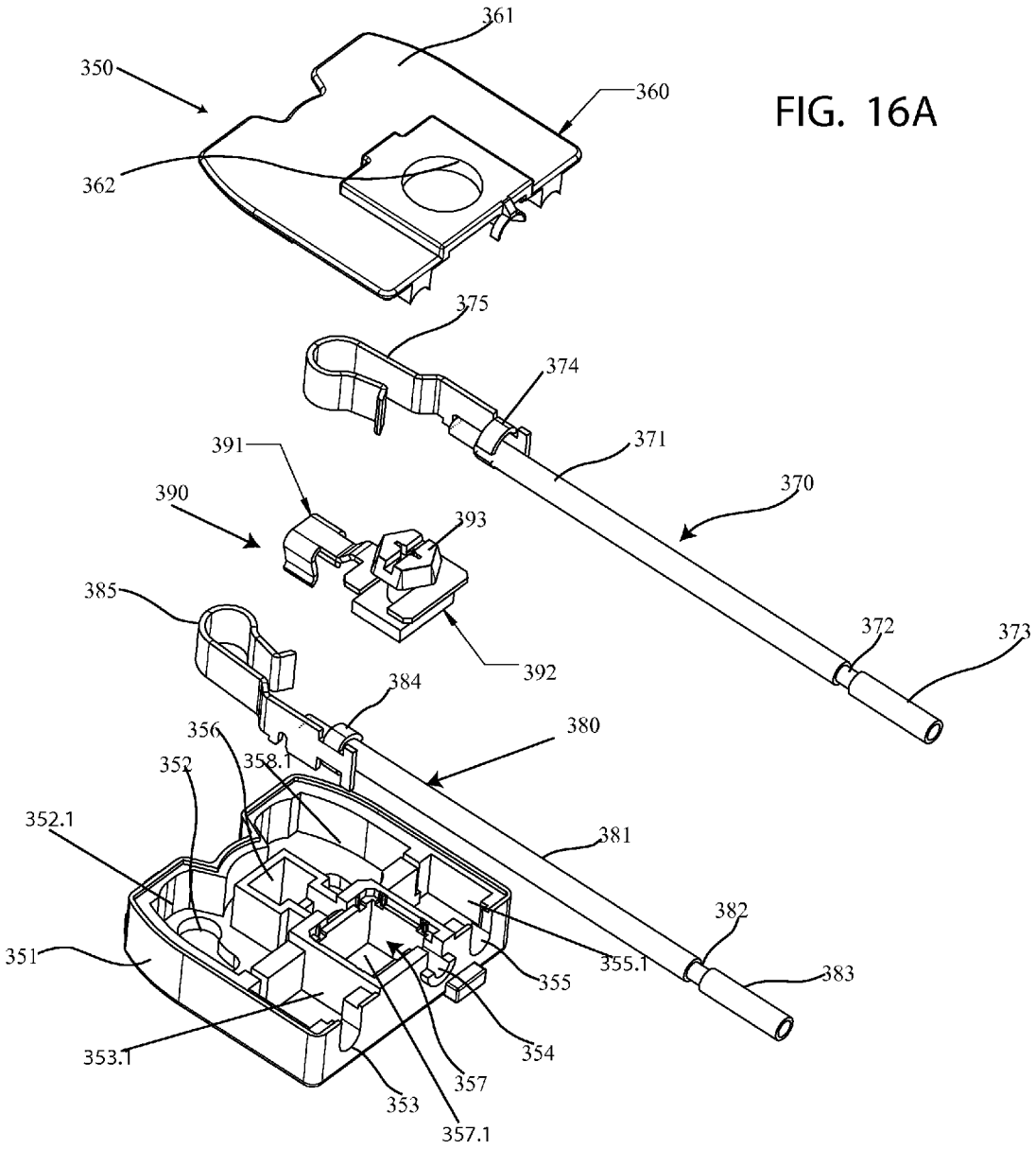
FIG. 16A shows a top exploded perspective view of one embodiment of a wiring module.

FIG. 16A is an exploded top perspective view of another embodiment of a wiring module 350 which includes a base section 351 a top cover 360, and wire lines 370, 380, and ground contact assembly 390. Base section 351 forms a housing with cover 360, to contain these wires. Base section 351 has a plurality of holes or openings for receiving prongs. These holes or openings include elongated hole/opening 352, elongated hole/opening 358, and center ground hole/opening 359 (See FIG. 16C). In addition, there are also a plurality of holes/openings and or channels which are configured to accommodate wires passing through into the interior.

There are multiple containers/compartments inside of the housing, for example, there are housings 352.1, 353.1 355.1, 356, 357.1, and 358.1 which are configured to receive different sections of a set of contacts. For example, coupling 384, and contact head 385 can fit inside of housings 353.1 and 352.1 respectively. In addition, coupling 374, and contact head 375 can fit inside of housings 355.1 and 358.1 respectively. Ground contact assembly 390 which includes ground base 392, ground screw 393, and ground contact terminal 391, fit inside of housings 356 and 357, with terminal 391 fitting inside of housing 356, and ground base 392, and ground screw or coupling 393 fitting inside of housing 357.

Lines 370 and 380 can be in the form of either a phase line or a neutral line, with line 370 having a line body 371, an open region 372, a tail end 373, and a contact end or coupling end in electrical communication with coupling 374. In one embodiment, coupling 374 may be crimped onto line 370. In addition, open region 372, allows tail end 373 to be removed so that the line 371 can have an exposed end that can be coupled to another line via a line connector such as a twist on or push-on wire connector, or the like.

Similar to line 370, line 380 has a line body 381, an open region 382, a tail end 383, and a contact end or coupling end in electrical communication with coupling 384. In one embodiment, coupling 384 may be crimped onto line body 381. In addition, open region 382 allows tail end 383 to be removed so that line 381 can have an exposed end that can be coupled to another line via a line connector such as a twist on or push on wire connector, or the like.

Ground assembly includes a ground contact 391, a ground body 392, and a ground screw 393 which can be screwed down to ground base 392. In this case, a ground wire can be slid through opening 354 which then allows this ground line to be coupled to ground assembly 390 via ground screw 393 screwing onto ground base 392. Alternatively, a ground wire can be wrapped around the ground screw as in traditional screw terminal connections. In yet another embodiment, the ground wire can be crimped to the ground contact or terminated in some other suitable manner known to those skilled in the art.

In one embodiment, a cover 360 can be snapped over body 351 or otherwise coupled to body 351. In this case, cover 360 includes a cover body 361, and a hole/opening 362 which is configured to receive a ground screw 393 or coupling element. Alternatively, cover 360 can be secured to body 351 in any other suitable manner, e.g., cover 360 and body 351 can be adapted and configured to permit cover 360 to be slid into coupling engagement with body 351. Still further, cover 360 can be more permanently sealed to body 351 by gluing, welding, staking, or any other method known to those in the art.

Figure 16B:
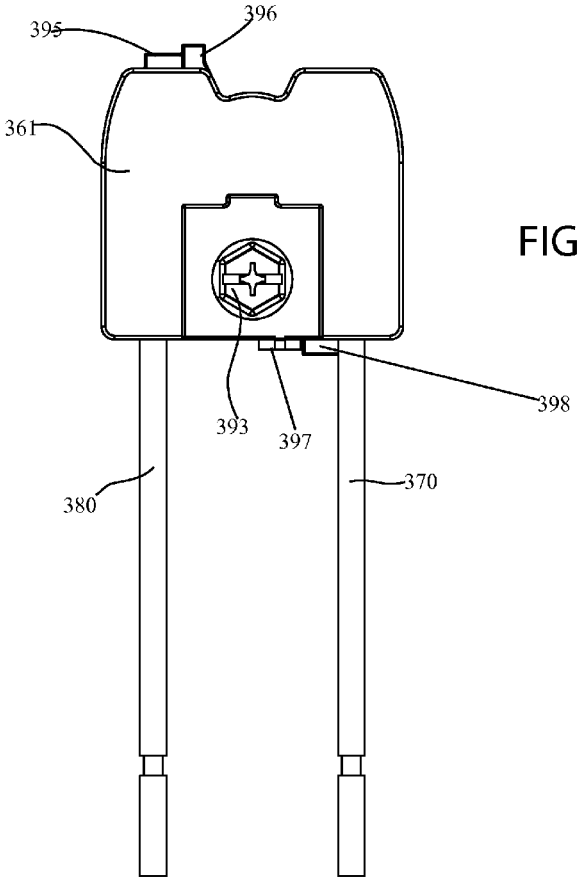
FIG. 16B shows a back view of the wiring module shown in FIG. 16A.

FIG. 16B shows one side of an assembled version of the embodiment shown in FIG. 16A. In this view, there is shown wiring device 350 (See FIG. 16A), cover 361, screw 393, lines 380 and 370, along with connecting flanges 395, 396, and 398. The connecting flanges are configured to guide and engage the wiring module with the functional module. The term engage or engaging can include physically coupling or in at least one instance locking the wiring device or wiring module to the functional device or functional module. In this case, the connecting flanges are used to connect the wiring device to the functional device in shown in FIGS. 19-21.

Figure 16C:
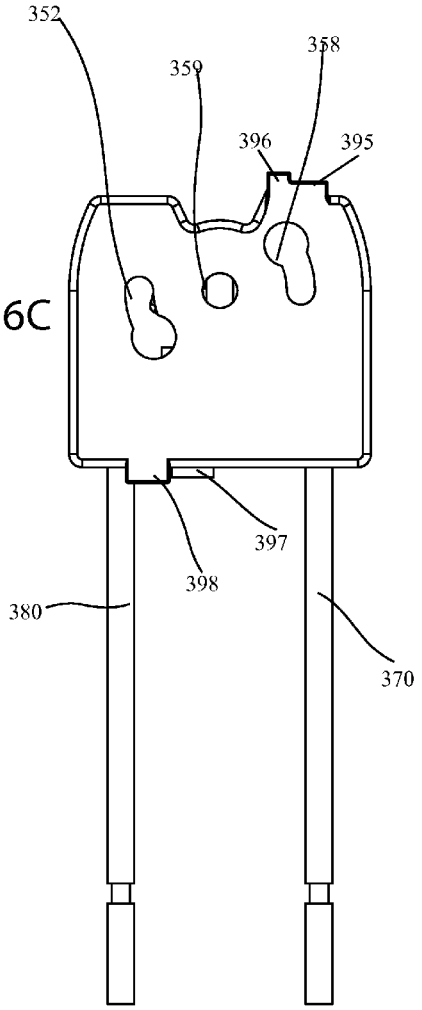
FIG. 16C shows a front view of the wiring module shown in FIG. 16A.

FIG. 16C shows the holes or openings for receiving bulb shaped or contacts disposed on the functional devices, such as posts, bulb shaped post ends, blades or the like. As shown, there are holes/openings 352, 359, and 358, with hole or opening 352 being the hole for receiving a prong for contact with contact end 385. With this view, holes or openings 352, and 358 are elongated openings, which are spaced substantially equidistant from a centrally positioned opening 359 which as described above, is the opening for receiving the ground prong on a functional module. Thus, when this wiring module is first coupled to a functional module, the ground prong inserts into opening 359 and the entire body of this wiring module is rotated about this ground prong to selectively lock or at least couple the wiring module to the functional module in the manner described above. As shown the openings and contacts are arranged to lie along a circumferential path having a single radius, however, it should be understood that the openings and associated contacts need not lie on a single circumferential path but can lie on a plurality of circumferential paths (not shown) of different radii that enable the rotational coupling of the wiring devices to the functional devices.

Figure 16D:
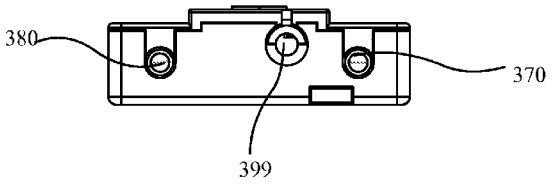
FIG. 16D shows a bottom view with respect to the orientation of the wiring module of FIG. 16B.

FIG. 16D shows one end which shows line 380, line 370 which as stated above can be either a phase line or neutral line, depending on the connection to a power line, and also ground line 399.

Figure 17A:
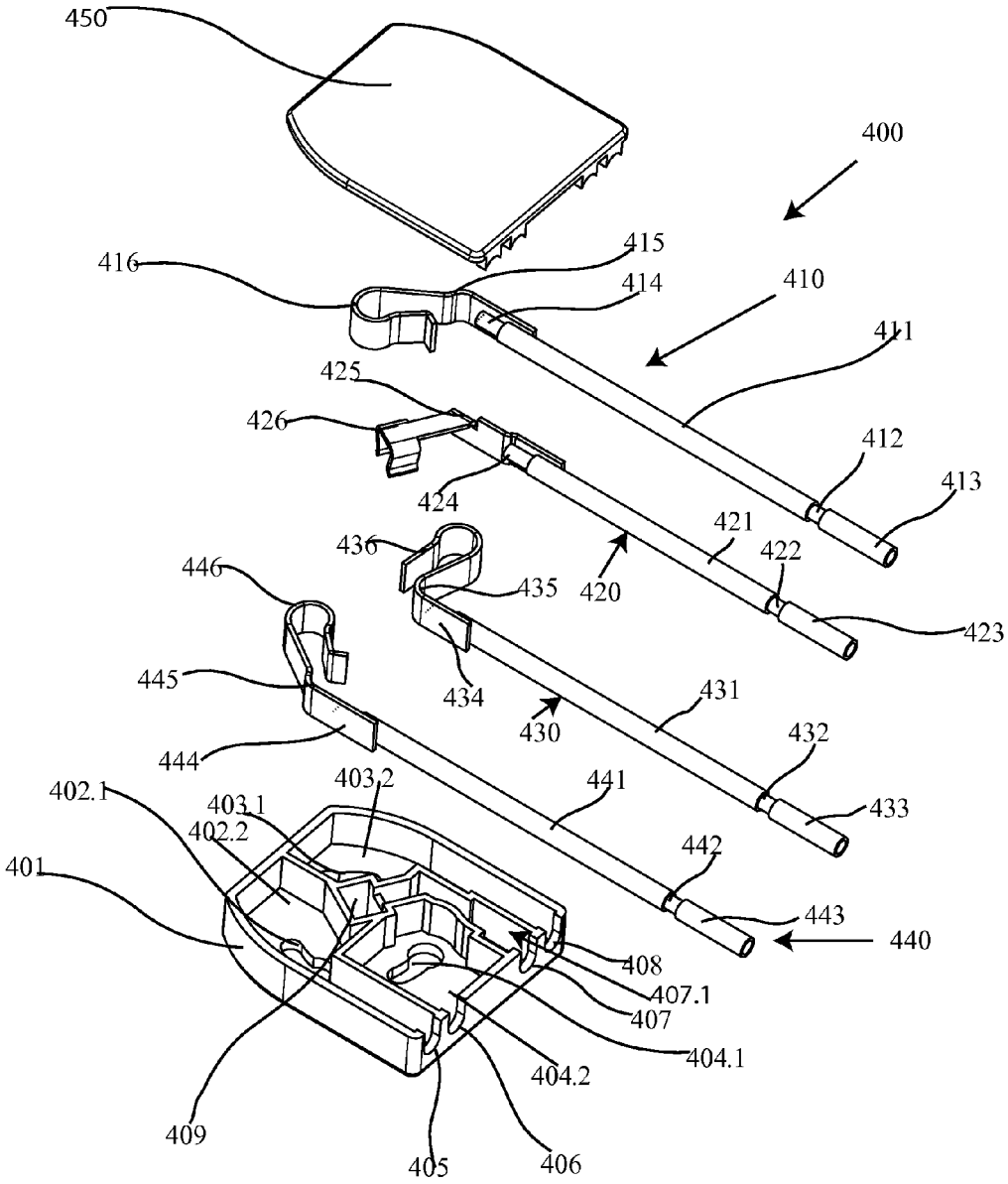
FIG. 17A shows a top perspective view of another wiring module having four different wiring lines.

FIG. 17A shows an exploded perspective view of another embodiment of a wiring module 400 which essentially has three functional lines, and one ground line for a total of four lines. As shown there is a base or body section 401 which includes an opening 402.1 and a housing 402.2. There is also an opening 403.1, and a housing 403.2. In addition, there is an opening 402.1 and a housing 402.2 as well. There is also at least two housings 407.1 and 409 for housing a ground contact.

At one end are a plurality of openings 405, 406, 407, and 408, wherein these openings are for receiving lines 411, 421, 431, and 441. Thus, when the associated contacts are installed into their respective housings, the lines can extend therethrough so that these lines extend outside of the housing.

Of lines 411, 431, and 441 at least one can be referred to as a traveler line, because at least one of these lines can be used in a three-way switch configuration.

Line 410 includes a body section 411, a gap section 412, and a tail end 413. There is also a contact section 414, which is connected to a contact having a bend section 415, and a contact end section 416, wherein contact end section is substantially U-shaped. Line 420 includes a body section 421, a gap section 422, and a tail end 423. There is also a contact end 424 which connects to a contact having a bend section 425, having a substantially U-shaped ground contact end.

Line 430 includes a body section 431, a gap section 432, and a tail end 433. Contact end 434 is connected to a contact having a bend section 435, which bends at a substantially right angle, and a contact end section 436 which is substantially U-shaped.

Line 440, includes a body section 441, a gap section 442, and a tail end 443. There is also an oppositely spaced contact end 444 which is connected to a contact having a bend section 445, and a U-shaped contact section 446. Each of these U-shaped contact sections have a wider or more open section to receive a contact, and a narrower section for engaging or even locking a contact therein.

The device can be assembled as follows: base or body 401 is presented open wherein traveler line 441 is inserted into body 401 with traveler contact terminal 446 inserting into housing 402.2. Line 441 extends through opening 405 and out of the body. In addition, traveler line 411 is inserted into body 401 with traveler contact 416 inserting into housing 403.2 and line 411 extending out of body 401. Traveler line 431 is also inserted into body 401 wherein traveler line contact 436 is inserted into housing 404.2 with the contact lining up with opening 404.1 such that the contact can accept a prong inserted thereto. In addition, a ground line 421 extends outside of the body through opening 407. Next, cover 450 is snapped onto body 401 or otherwise coupled to body to create a closed housing.

Figure 17B:
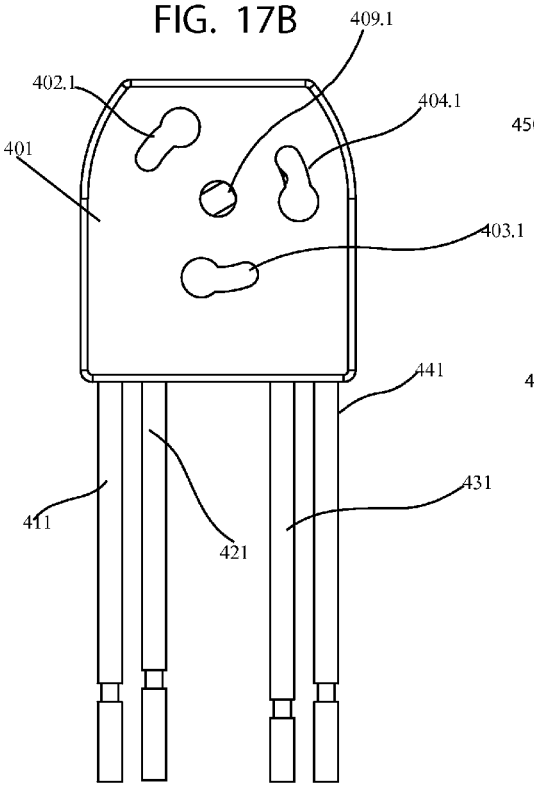
FIG. 17B shows a front view of the wiring module shown in FIG. 17A.

FIG. 17B shows a first front face of the device shown in FIG. 17A, with body section 401 showing holes or openings 402.1 403.1, 404.1 and 409.1 which are used to allow prongs or other contacts to enter the body. In addition, extending out of body 401, are lines 411, 421, 431, and 441. With this design, the additional hole or opening such as hole or opening 404.1 which leads to the additional contact allows for an additional controlling line to be used such as with a dimmer switch to control the dimming or light levels of a device.

With this view, holes or openings 402.1, 403.1 and 404.1 are elongated holes or openings which are spaced substantially equidistant from a substantially centrally positioned opening or hole 409.1 wherein the hole or opening is for receiving the ground prong on a functional module. These elongated holes or openings have a wider region for receiving a prong from a functional module and a narrower region for engaging or even locking a prong therein. Thus, when this wiring module is first coupled to a functional module, the ground prong inserts into opening 409.1 and the entire body of this wiring module is rotated about this ground prong to selectively lock or couple the wiring module to the functional module in the manner described above. In this way, the other numerous prongs which are inserted into openings 402.1, 403.1 and 404.1 also rotate relative to these openings so that these prongs are engaged with and/or locked into these openings. This design allows the wiring module to be selectively rotated back, so that the wiring module can be unlocked, or even unengaged from the associated functional module. This allows the wiring module to be selectively decoupled from the functional module.

Figure 17D:
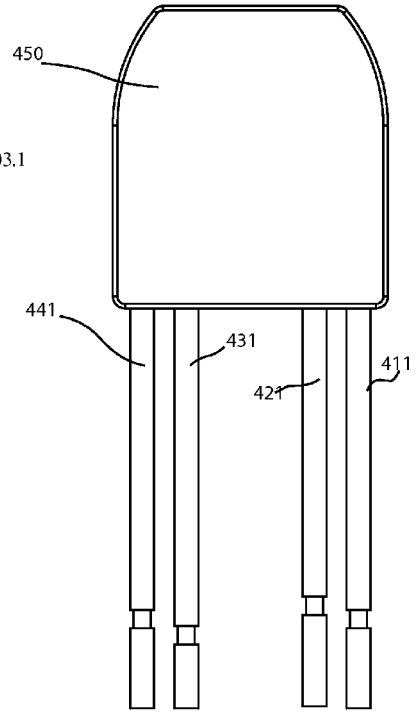
FIG. 17D shows a bottom view with respect to the orientation of the wiring module of FIG. 17B.
Figure 17C:
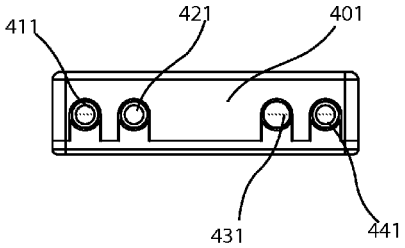
FIG. 17C shows a back view of the wiring module shown in FIG. 17A.

FIG. 17C shows an end view which shows lines 411, 421, 431, and 441 extending out from body 401. FIG. 17D shows a view that is opposite the view shown in FIG. 17B wherein this view shows cover 450.

Figure 18A:
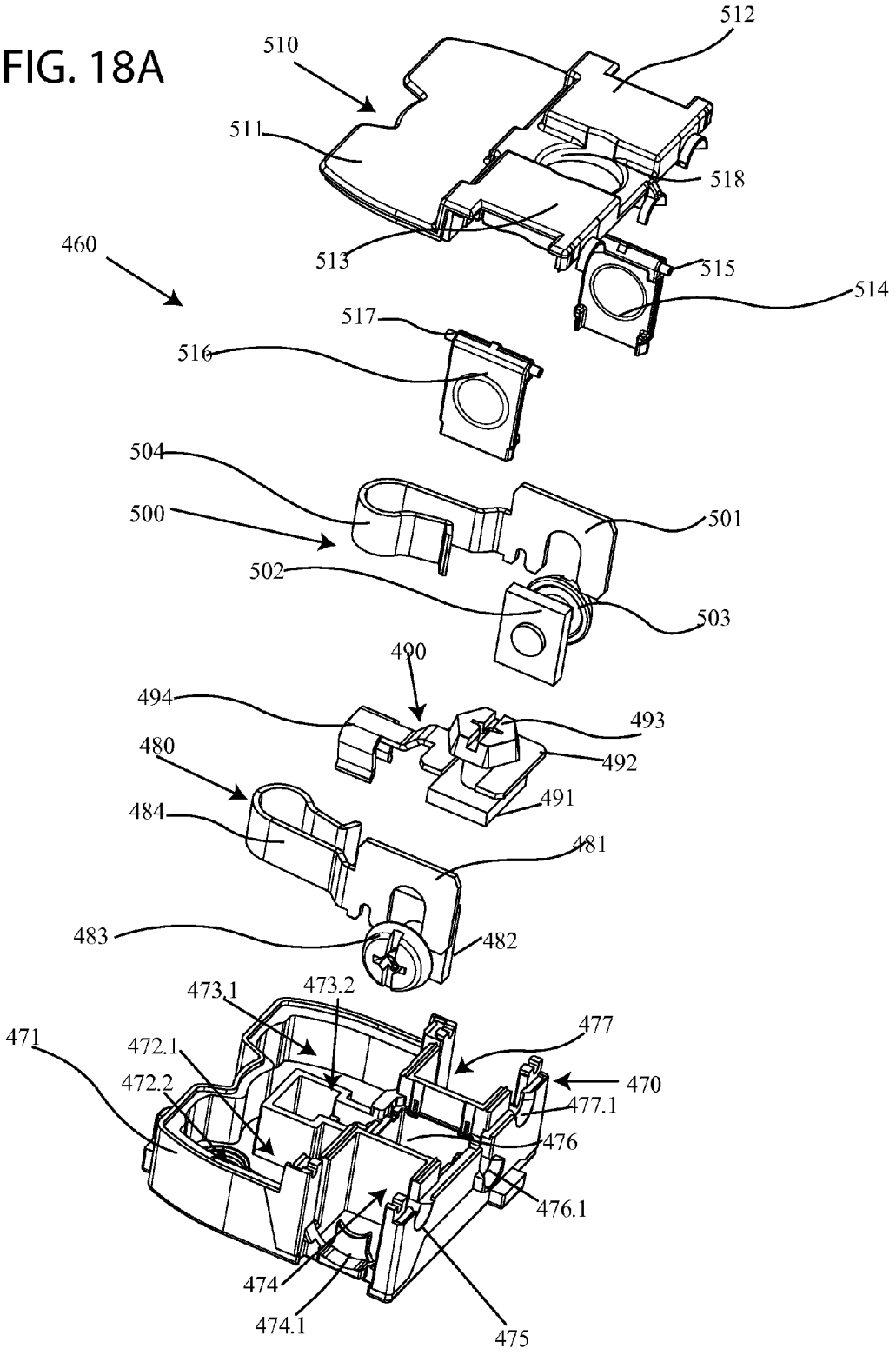
FIG. 18A shows a top perspective view of another embodiment of a wiring module.

FIG. 18A shows an exploded view of another embodiment. In this view, there is shown another embodiment which shows a design 460 which has a body section 471 which has a plurality of different housings. Body section 471 can be made from any appropriate material but its most preferable material is plastic. In this case, body section 471 includes different housings 472.1 473.1 477, 476, and 474.

There are also different contacts 480, 490 and 500 which can be made from any appropriate material such as metal. Contacts 480 and 500 comprise two different contacts which are configured to connect to lines such as phase and neutral lines. Contact 490 comprises a ground contact which is configured to connect to a ground line.

Contact 480 comprises a contact body 481, a contact backing or pressure plate 482, and a contact screw 483 which screws into contact backing 482. In addition, there is a contact terminal 484 which is configured in a U-shaped manner and which has a wider opening at the terminal end in a manner similar to contact ends 375, 385, 416, 426, 446 and 504. This wider opening at the end allows the head of a bulb-shaped contact to fit therethrough and then to be slid and engaged or even locked into place. This locking can be such that it prevents axial movement of the wiring module away from the functional module to prevent the disengagement of the wiring module from the functional module. Contact screw 483 is screwed into contact backing 482 and is used to clamp down on wires or lines between backing 482 and contact body 481. Thus, when clamping contact or screw 483 is screwed into contact backing 482, it clamps contact backing 482 against contact body 481 to create a snug connection with an exposed wire.

Similarly, clamping contact or screw 503 is screwed into clamp body 502 to clamp clamp backing 502 into body 501. This type of connection is an electrically conductive connection, thereby allowing power to be supplied to terminal ends 504, 484, or to terminal ends 375, 385, 416, 426, and 446.

Ground contact 490 includes a ground contact body 491, ground contact clamp body 492, and ground contact screw 493, which screws into ground contact clamp body 492. In addition, there is a ground contact terminal end 494 for receiving a ground prong. Cover 510 can be snapped or coupled onto body 471 with side covers 516 and 514 covering screws 483 and 503. Side cover 514 has a hinge 515 which snaps into raised cover section 512, while side cover 516 has a hinge 517 which snaps into raised cover section 513.

To assemble the device, contacts 480 and 500 insert into body section 471 with terminal ends 484 and 504 fitting into housings 472.1 and 473.1 respectively. Ground contact 490 fits into housing 473.2 and 476. Either before or after these contacts are inserted into the body, wires can be coupled to these contacts with screws such a screws 483, 493, and 503 clamping to clamp bodies 482, 491, and 502. When contacts 480 and 500 insert into body 471, a back contact holder such as holder 474.1 is used to secure the contacts such as contact 480 or a contact 500 into the housing so that these contacts do not move laterally inside of the housings.

Figure 18B:
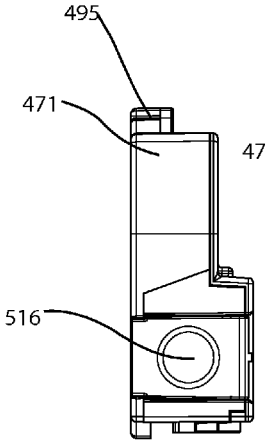
FIG. 18B shows a side view of the wiring module shown in FIG. 18A.
Figure 18C:
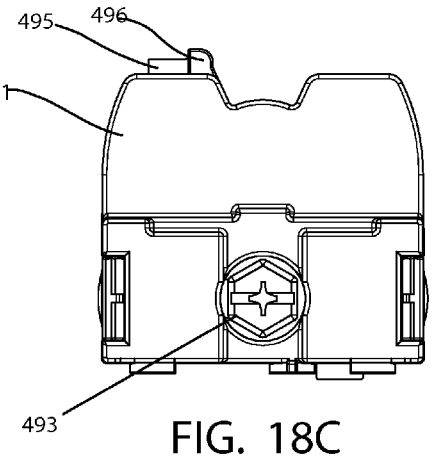
FIG. 18C shows a back view of the wiring module of FIG. 18A.

FIGS. 18B-18G show the different views for the embodiment shown in FIG. 18A. For example, FIG. 18B shows a side view which shows side cover 516 coupled to housing or body 471, with connection flange 495 shown extending outside of body 471. Connection flanges 495 and 496 extend out from a side of body 471 to provide a locking flange for connecting with an associated flange on the functional module. FIG. 18C shows a back side view which shows ground screw 493 coupled to body 471.

Figure 18D:
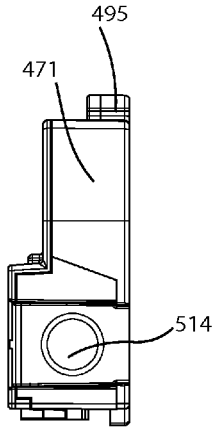
FIG. 18D shows a side view of the wiring module which is opposite the view of FIG. 18B.
Figure 18E:
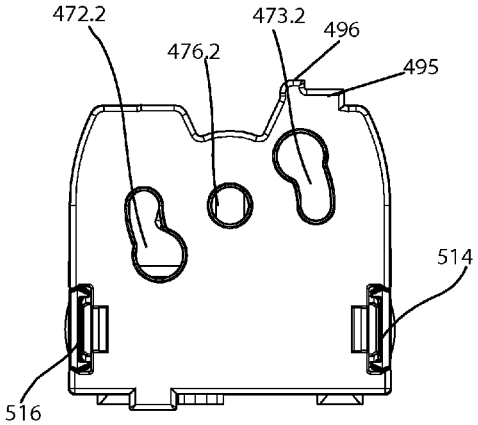
FIG. 18E shows a front view of the wiring module.

FIG. 18D shows an opposite side view from the view shown in FIG. 18B, wherein in this view, there is shown side cover 514 which is coupled to body 471. FIG. 18E shows a side view which is opposite the side view of FIG. 18C and which shows openings 472.2, 476.2, 473.2, which are configured to allow prongs to be inserted therein. Openings 472.2 and 473.2 are spaced substantially equidistant from substantially center opening 476.2 which serves as an opening for receiving a ground prong. This opening allows the wiring module to be rotated about this ground prong so that other prongs on the wiring module can be used to lock the wiring module to the functional module.

Figure 18F:
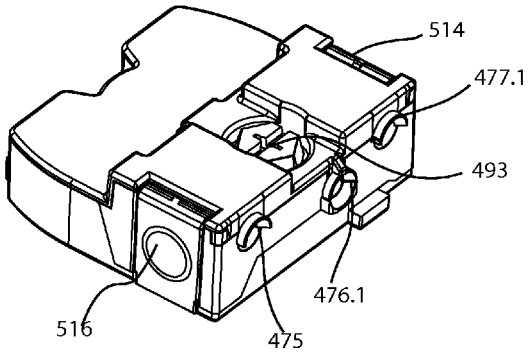
FIG. 18F shows a back perspective view of the wiring module.
Figure 18G:
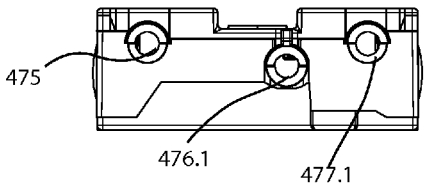
FIG. 18G shows a bottom view of the wiring module with respect to the orientation shown in FIG. 18B.
Figure 18H:
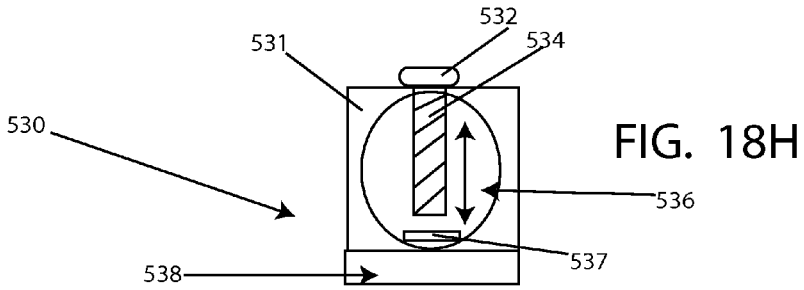
FIG. 18H shows an alternative type of connection solution for connecting a wire to a contact.
Figure 18I:
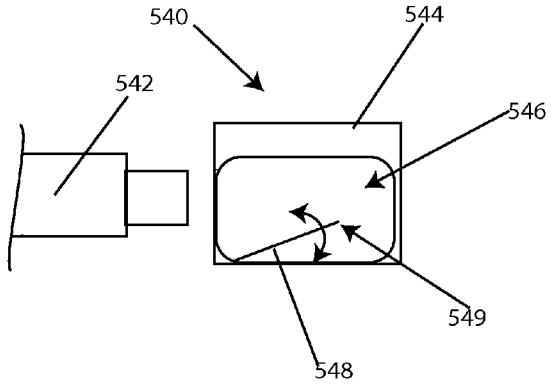
FIG. 18I shows a second alternative type of connection solution for connecting a wire to a contact.
Figure 18J:
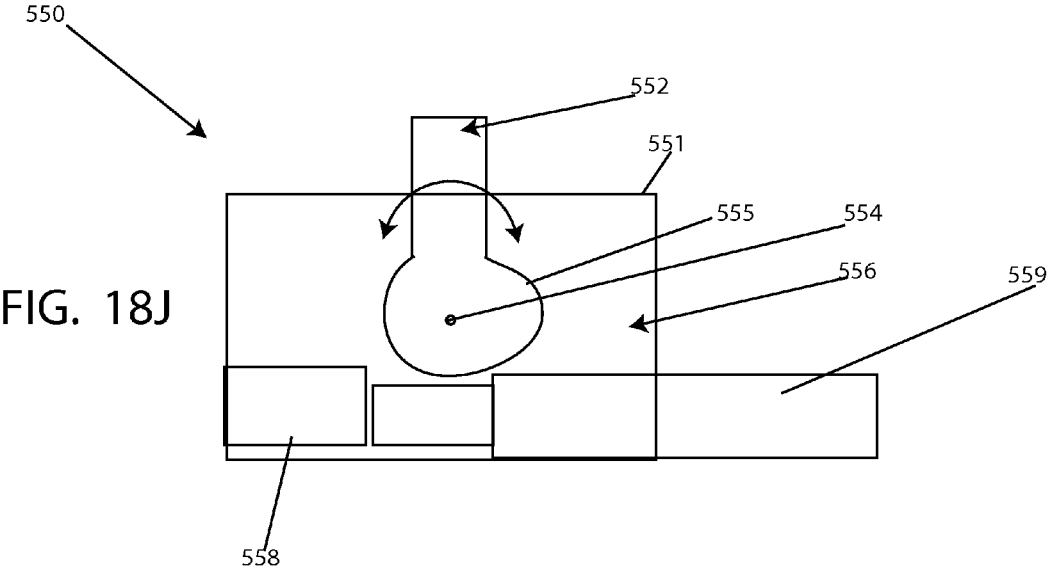
FIG. 18J shows a third alternative type of connection solution for connecting a wire to a contact.

FIG. 18F shows a perspective view of the assembled device which shows side covers 514, and 516 and back holes or openings 475, 476.1 and 477.1. FIG. 18G shows a back view of the device which shows back holes or openings 475, 476.1, and 477.1. For the embodiments which incorporate screw terminals, the terminals can be of any suitable configuration such as wrap or side wire, straight-in wiring a screw, screw plate, and clamp body (in other installations, this would be known as backwiring), or push-in wiring, or a combination thereof. For example, FIGS. 18H, 18I, and 18J show different connection types that are possible. For example, FIG. 18H shows a first type of connection element 530 which is a screw clamping connection, wherein a screw 532 having a shaft 534 is screwed into a housing 531. The housing has an opening 536 which is configured to receive a wire or contact such as a wire from building wiring. Inside of housing 531 and disposed within opening 536 is a contact 537 which is configured to connect with contacts such as contacts 484, 494 and 504 shown in FIG. 18A. When screw 532 is screwed into housing 531, this clamps a wire into housing 531 to both electrically and physically connect an associated wire with housing contact 537 and to lock the wire inside of housing 531.

FIG. 18I shows another connection solution 540, which is a push wire solution which includes a housing 544, having an opening 546, and a locking contact 548 in the form of a leaf spring. This locking contact 548 is rotatable as shown by the associated arrow, so that when a wire such as wire 542 is pushed into opening 546 inside of housing 544, the leaf spring bends down to make room for the wire and then once the wire is fully pushed in, the terminal end 549 of this locking contact 548 provides a lock which prevents removal of the wire from the housing.

FIG. 18J shows another type of connection solution in the form of a cam connector 550. Cam connector 550 includes a housing 551, and a cam 552 having an eccentric end 555 which is rotatable about an axis 554 inside an opening 556 in housing 551. Therefore, a wire, such as wire 559 can be pushed into housing 556 and then clamped therein via cam 552 having eccentric end 555 which as shown by the associated arrow can be rotated down to clamp the wire inside of the housing. Once this cam is rotated around, it not only clamps the wire inside of the housing it puts the terminal end of wire 559 into electrical contact with contact 558 disposed inside of housing 551. Contact 558 can be in contact with contacts 484, 494, or 504 shown in FIG. 18A, so that wiring providing from building wiring can provide power to the contact ends disposed inside of an associated wiring module such as wiring module 510 shown in FIG. 18A or the wiring modules shown in FIGS. 16A and 17A. Another example of this cam system is disclosed in U.S. patent application Ser. No. 12/474,640 to Edward Joy, which is titled "Wiring Termination Mechanisms and Use Thereof" which was filed on May 29, 2009 and which is assigned to Leviton Manufacturing Company Inc, the disclosure of which is hereby incorporated herein by reference in its entirety.

The wiring modules 350, 400 and 460 of 16A, 17A and 18A also differ in the geometries of their outer housings or bodies. This creates a unique system wherein a particular wiring module may have a particular geometry to fit a particular functional module. For example, a functional module that is associated with a simple in wall mounted receptacle could require a wiring module which has a different wiring configuration. Therefore, to prevent the connection of a wiring module which is intended for a switch with a functional module comprising a receptacle, the bodies such as body 351, 401, and 471 form keys which are particularly designed for locking with particular functional modules. This keying or the forming of a key from this geometry includes both the geometry of the body as well as that of any connection flanges such as connection flanges 395, 396, 495, 496.

Figure 19:
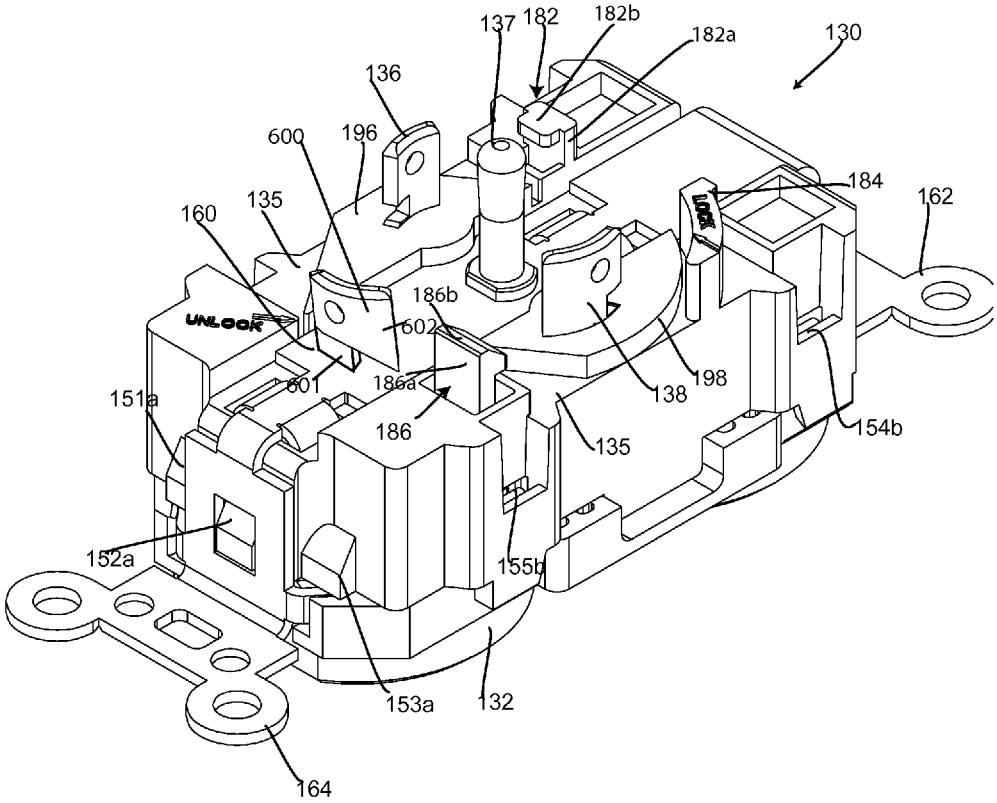
FIG. 19 shows a back perspective view of a functional module having an additional prong than that shown in FIG. 8.

FIG. 19 shows a back perspective view of a functional module which shows all of the elements previously shown in FIG. 8 and, which also shows an additional prong 600 which can be arcuate shaped, extending out from a back face of the housing. In this case, prong 600 includes a first extending portion 601 which is narrower than a second extending portion 602. First extending portion 601 is narrower than second extending portion 602 which thereby forms a gap for locking this prong to a wiring module as discussed above. With this design, the additional prong, such as prong 600 can be used to couple with a fourth opening in a face of a wiring module, wherein this fourth opening allows a controlling wire to be coupled to or be in electrical communication with the functional elements of the functional module.

Figure 20:
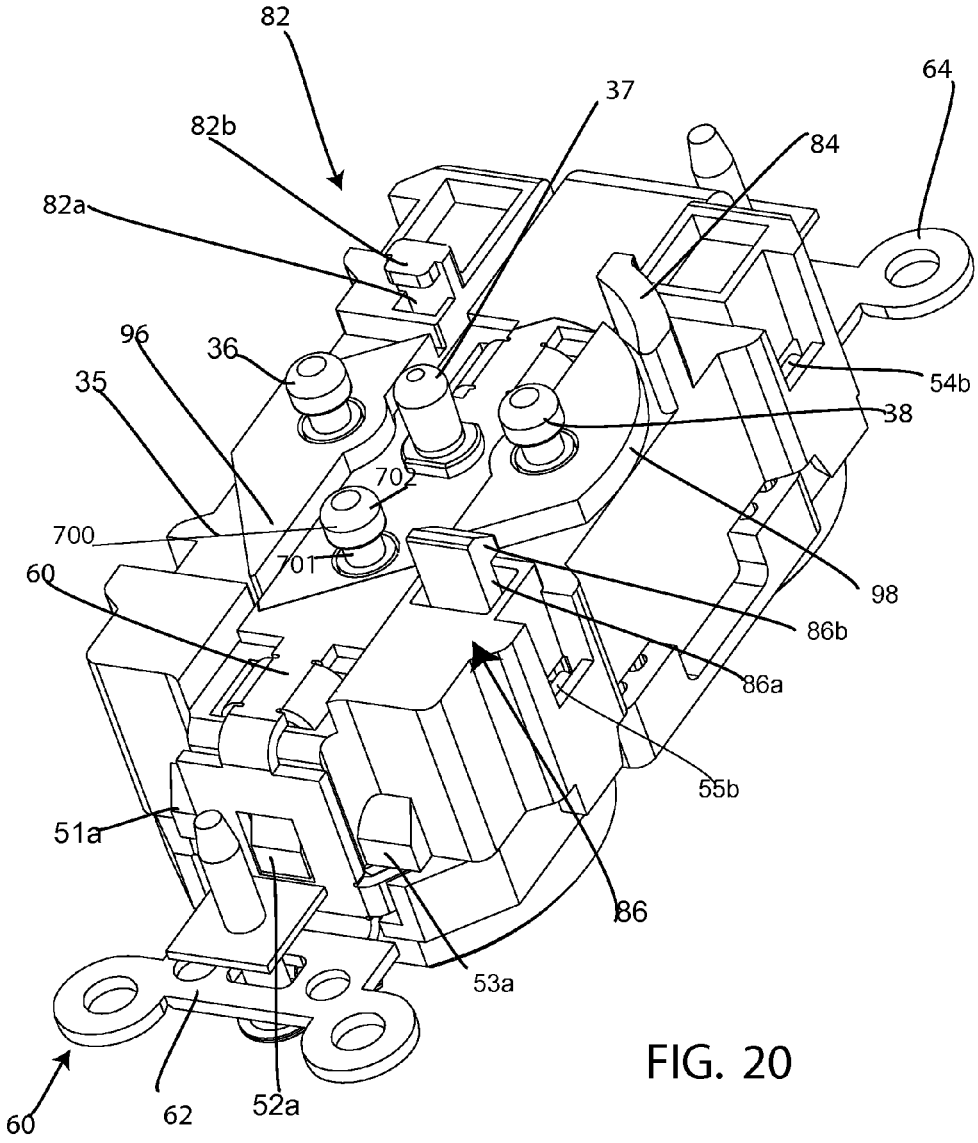
FIG. 20 shows a back perspective view of a functional module having an additional prong.

FIG. 20 shows a perspective back view of another embodiment of a functional module, wherein with this module, it is similar to the functional module shown in FIG. 5B, however, there is an additional prong 700 which extends out from a back face of this device. This additional prong 700 has a first extending portion 701, which is narrower than second extending portion 702. First extending portion 701 extends out from the back face to a point where it expands into a bulb shaped region or second extending portion 702. This bulb shaped region or second extending portion can be used to lock this functional module to a wiring module such as wiring module 400 shown in FIG. 17A.

The combination of the functional module shown in FIG. 20 and the wiring module shown in FIG. 17B allows for the connection of three electrically conducting lines between the wiring module and the functional module. The three electrically conducting lines can be in the form of a phase conductive line, a neutral conductive line and a control line which in at least one form can be controlled by a dimmer or additional switch. Another type of electrically conductive line could be in the form of an additional phase line, to create a two phase system.

Figure 21:
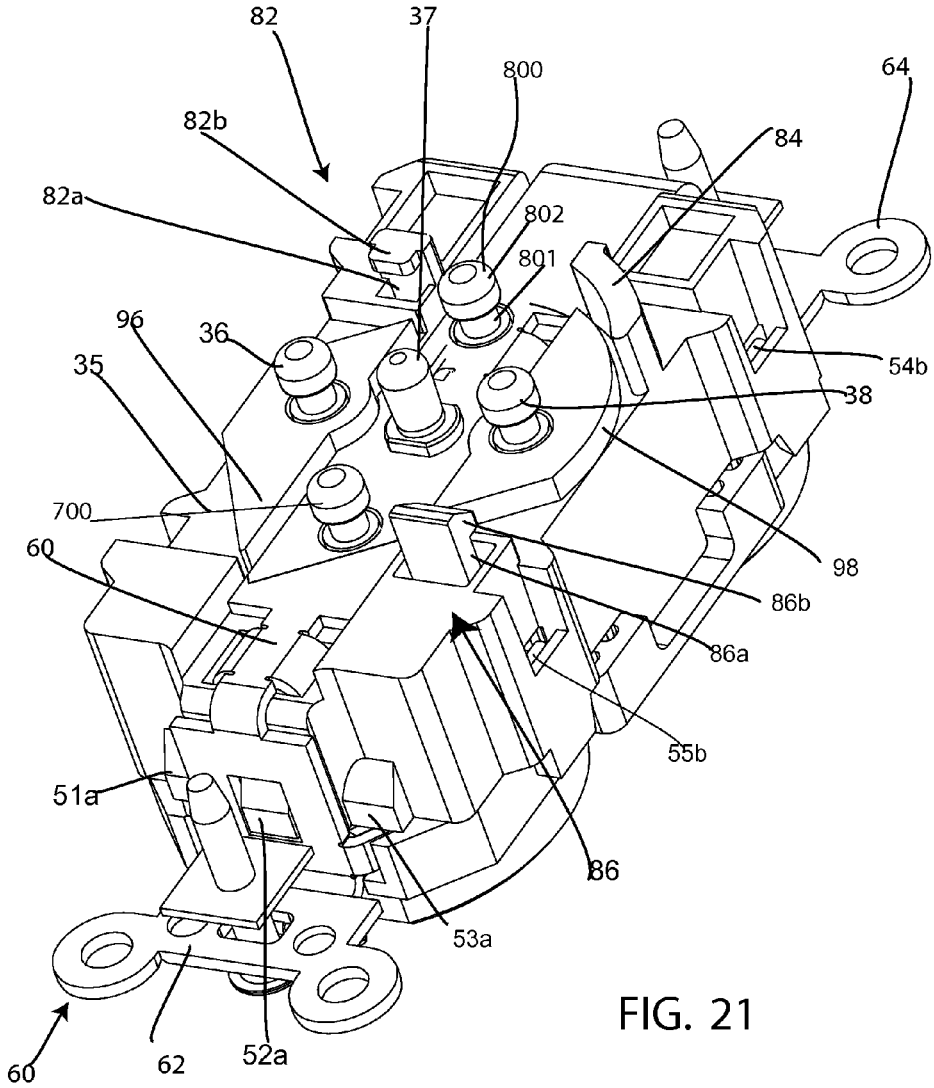
FIG. 21 shows a back perspective view of a functional module having a fifth prong.

FIG. 21 shows another embodiment of a functional module such as that shown in FIG. 20, however, this functional module includes an additional prong 800, which includes a first extending portion 801, and a section extending portion 802. First extending portion 801, extends out from the back face and is narrower than second extending portion 802. Second extending portion 802 forms a locking section shaped as a bulb for locking with a wiring module such as the wiring module 805 shown in FIG. 22.

Figure 22:
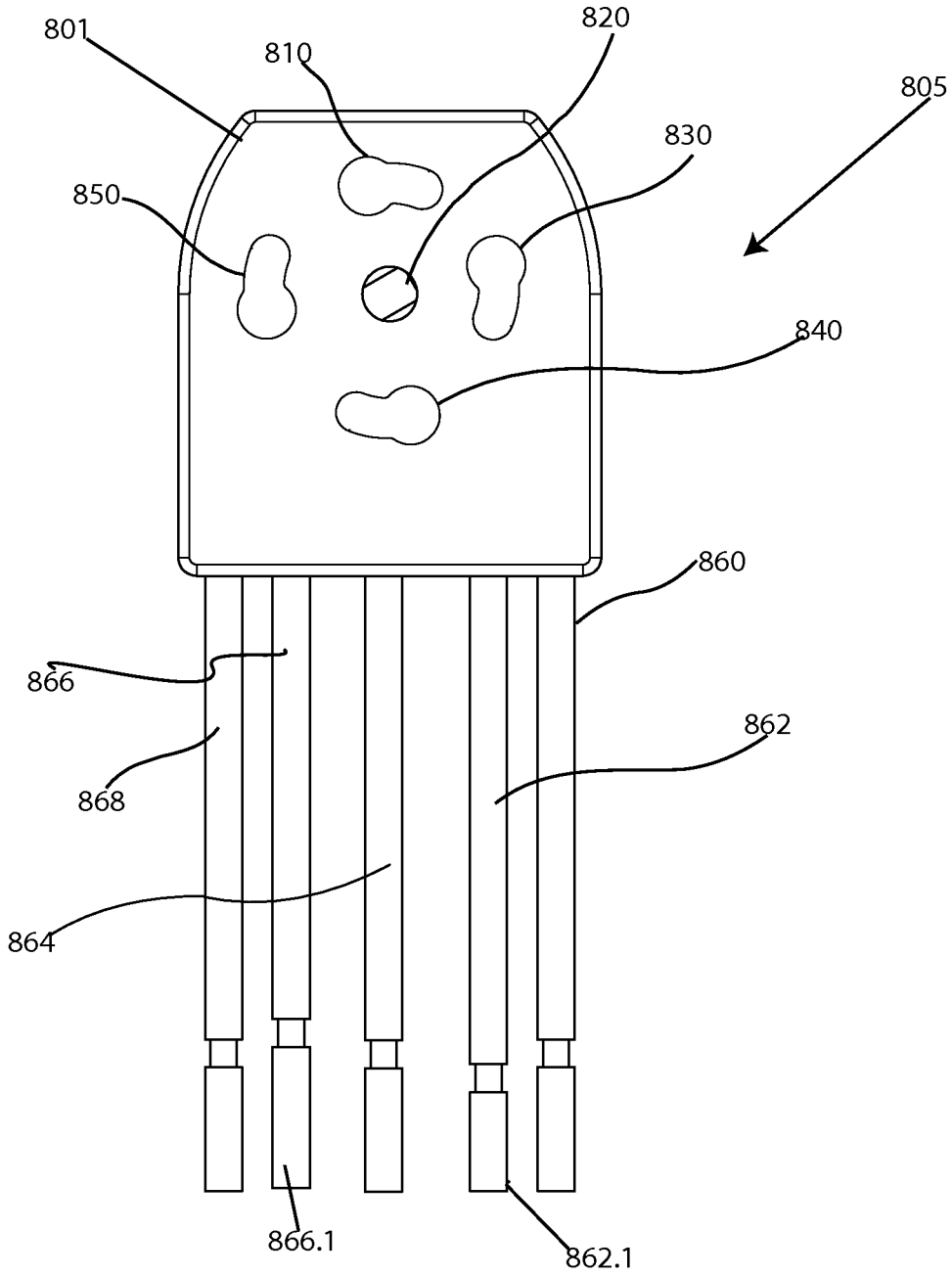
FIG. 22 shows a front face of a wiring module having a fifth opening for receiving a fifth prong from a functional module shown in FIG. 21.

As shown, the functional modules of FIGS. 19-21 are in wall mountable functional modules, which are configured to be installed into a wall box such as a single gang wall box. These functional modules have contacts or prongs disposed on their back face to allow connection of a wiring module to the back face. This connection of the wiring module to the back face, locks the otherwise freely movable wiring module in place so that it remains immobile inside of a wall box. The functional module can include a receptacle such as an in wall mountable single gang duplex receptacle capable of having multiple feeds, a switch including but not limited to a two-way, or three way switch, a combination device such as a switch and receptacle, a receptacle and nightlight, or a switch, receptacle and nightlight, an occupancy sensor, any type of fault circuit interrupter including but not limited to a ground fault circuit interrupter (GFCI), an arc fault circuit interrupter (AFCI), an electrical leakage circuit interrupter (ELCI), an overvoltage circuit interrupter, an overcurrent circuit interrupter, or even a remote controlled home automation module In this embodiment, shown in FIGS. 21 and 22, there are four basic power carrying lines, and a fifth line in the form of a ground line. Thus, with this embodiment, two of the lines such as lines 860 and 868 can be coupled to a power line along with ground line 864. Power would then be supplied to the face of these contacts wherein openings 830 and 850 allow access to these contacts. The contacts which are exposed by openings 810 and 840 are coupled to wires 862 and 866. These contacts would selectively contact prongs 800 and 700 as shown in FIG. 21. In addition, two other lines 862 and 866 can be coupled to additional lines such as load lines such as a phase line and a neutral line. An electrical cable which can include these load lines can be coupled to a downstream load. As shown in FIG. 22, there is a substantially centrally positioned opening 820 which serves as an opening for receiving a ground prong, in addition there are also a plurality of surrounding elongated openings 810, 830, 840, and 850, wherein these elongated surrounding openings are spaced substantially equidistant from this center ground opening. This spacing allows the wiring module to be inserted onto a back of a functional module, with the ground prong of the functional module serving as a center rotation point, thereby allowing the wiring module to rotate about a center axis to allow multiple peripheral prongs to rotate relative to the peripheral openings and to thereby lock into respective elongated openings 810, 830, 840, and 850.

Prongs 800 and 700 which are coupled to the back face of the functional module shown in FIG. 21 are selectively coupled to a power source that is supplied to prongs 36 and 38 such that prongs 36 and 38 form line prongs and prongs 700 and 800 are load prongs. Thus, prongs 700 and 800 are selectively disconnectable from the power via a fault circuit and an actuator, which selectively disconnects power to the face and to load terminals. While any known fault circuit can be used, an example of one fault circuit is found in U.S. Pat. No. 6,246,558 to Nicholas Disalvo and William Ziegler, filed on Aug. 20, 1999, and which issued on Jun. 12, 2001, the disclosure of which is hereby incorporated herein by reference. With this design, downstream loads would still be protected from the occurrence of a fault. The fault circuitry can be in the form of arc fault circuitry (AFCI), ground fault circuitry (GFCI), immersion detection circuitry (IDCI), overvoltage, surge protection, overcurrent or any other known circuitry which can be used to detect a fault. Alternatively, the functional unit may be in the form of a remote control device which can extend this functionality to downstream devices.

While the above embodiments disclose that the center prong is a ground prong, it is possible to have a configuration of a functional module wherein the center prong is not a ground prong but rather a phase or neutral prong connected to a power line or to a load. Therefore, these other configurations are possible as well.

Figure 23:
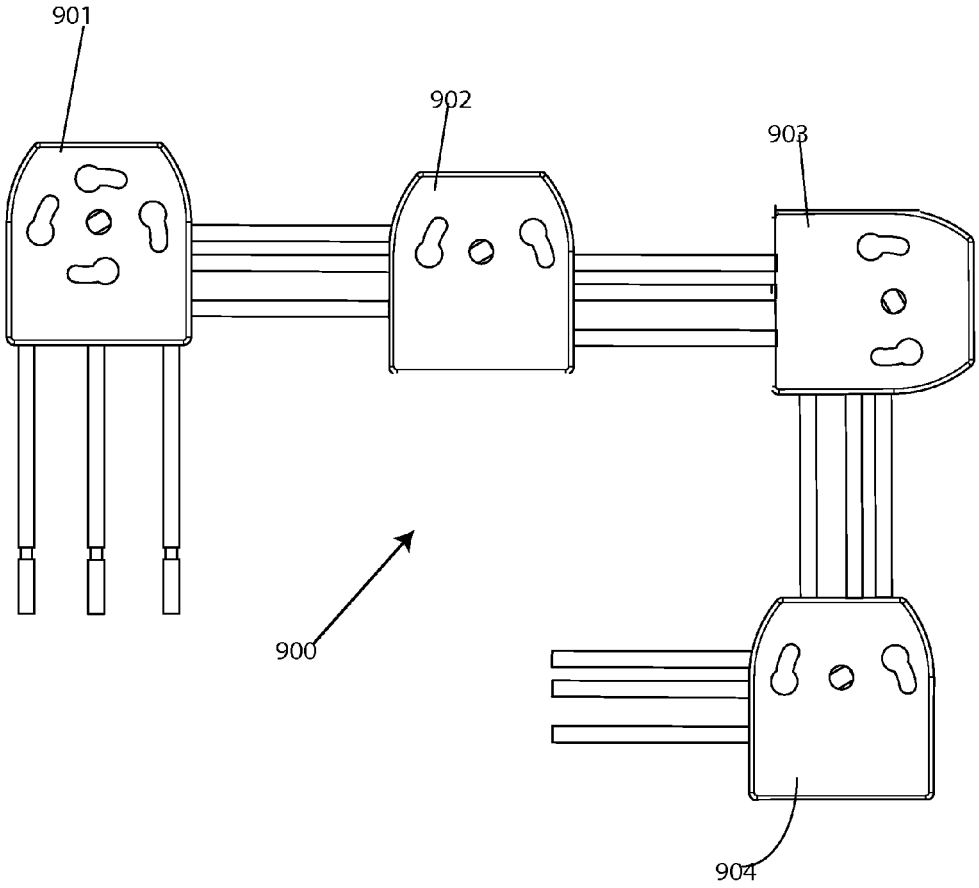
FIG. 23 shows another embodiment which shows different wiring modules in a preconfigured connection.

FIG. 23 shows another embodiment of wiring modules 900 which shows multiple wiring modules, 901, 902, 903, 904 which are essentially daisy chained along in series, such that if the first wiring module is connected to fault detection circuitry, all of the other wiring modules would be protected by this fault detection circuitry based upon the wiring of the prongs inside of the first functional module. This design allows for the quick connection of different electrical components to different wiring modules while still allowing power to pass from an original power distribution line to multiple downstream loads.

Figure 24:
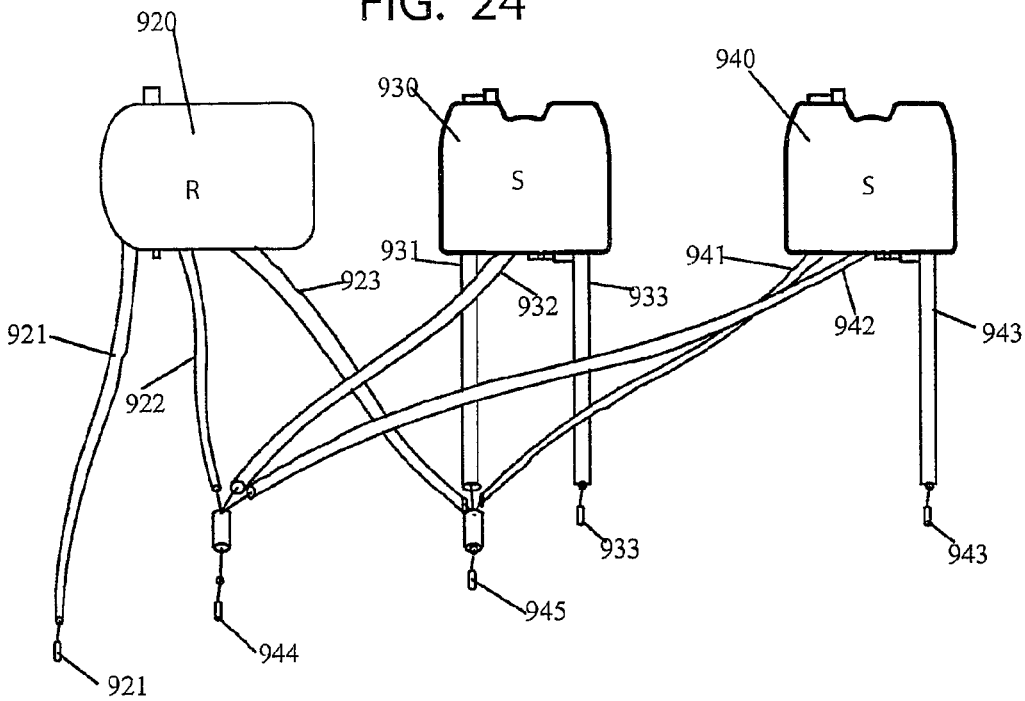
FIG. 24 shows a series of wiring modules in a first wiring configuration.
Figure 25:
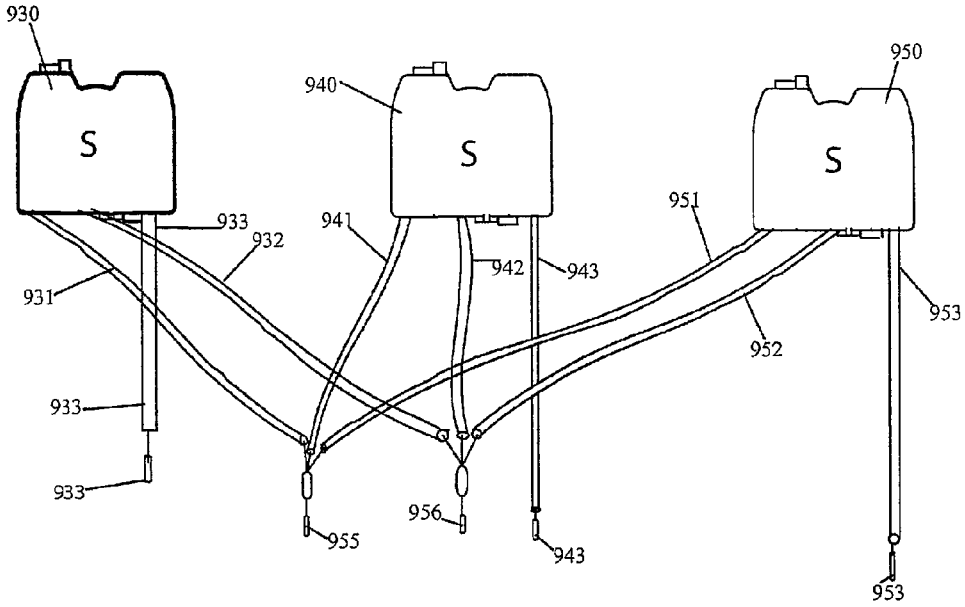
FIG. 25 shows a series of wiring modules in a second wiring configuration.

FIG. 24 shows another embodiment which shows multiple wiring modules 920, 930, and 940 which have lines electrically coupled together. Module 920 has a neutral line 921, a ground line 922, and a hot line 923. Wiring module 930 has a hot line 931, a ground line 932, and a load line 933. Wiring module 940 has a hot line 941, a ground line 942, and a load line 943. The assorted ground lines 922, 932, and 942 are coupled together with a ground line tie, coupler or connector 944. The hot lines are all coupled together with a hot line tie coupler, or connector 945. The end of neutral line 921 is coupled to a wiring neutral line, while the end of load lines 933 and 943 are coupled to load lines or to other loads which are positioned downstream from the present design. The lines may be coupled together using any suitable means such as twist on wire connectors, welding, brazing, crimp connectors, or the like FIG. 25 shows a plurality of switch wiring modules 930, 940, and 950 which are coupled together and used to control a set of switches such as triple ganged switches. Wiring module 930 has wiring line 931, which is a line wire which is coupled to other line wire lines 941 and 951 via a connector 955. Connector 955 can be in the form of any known connector but in at least one embodiment is in the form of a twist on wire connector. Another connector can be used which is in the form of a twist on wire connector 956 which is used to connect ground lines 932, 942, and 952 together. In this way a cable having a load line, can be connected to the connection ends of line 933, and to lines 943 and 953 to power all three devices. The lines 931, 941 and 951 can then be connected to input loads to the devices.

Figure 26:
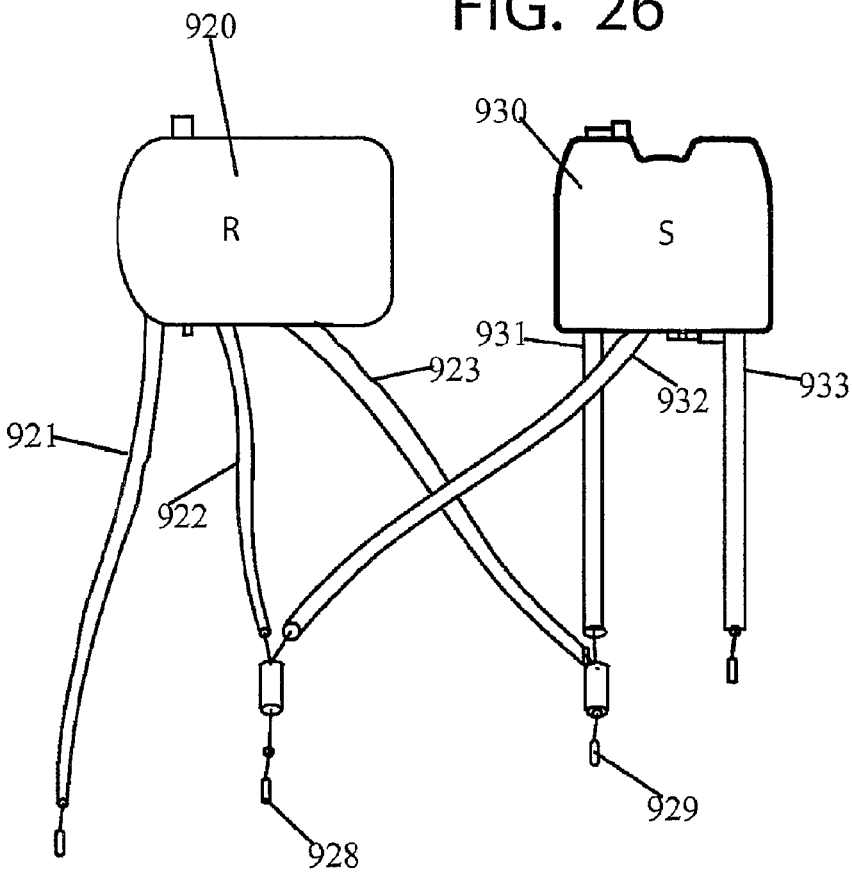
FIG. 26 shows a series of wiring modules in a third wiring configuration.

FIG. 26 shows another layout which shows a receptacle wiring module 920, which has its ground lines 922, and 932 coupled together via a connector 928 and its phase or hot lines 923 and 931 lines coupled together via a connector 929. With this connection configuration, a power distribution line or cable having a phase line, and a ground line can be coupled to these two different wiring modules in a simplified manner, such that one power distribution line can be used to provide power to the face of the two different wiring modules.

Figure 27:
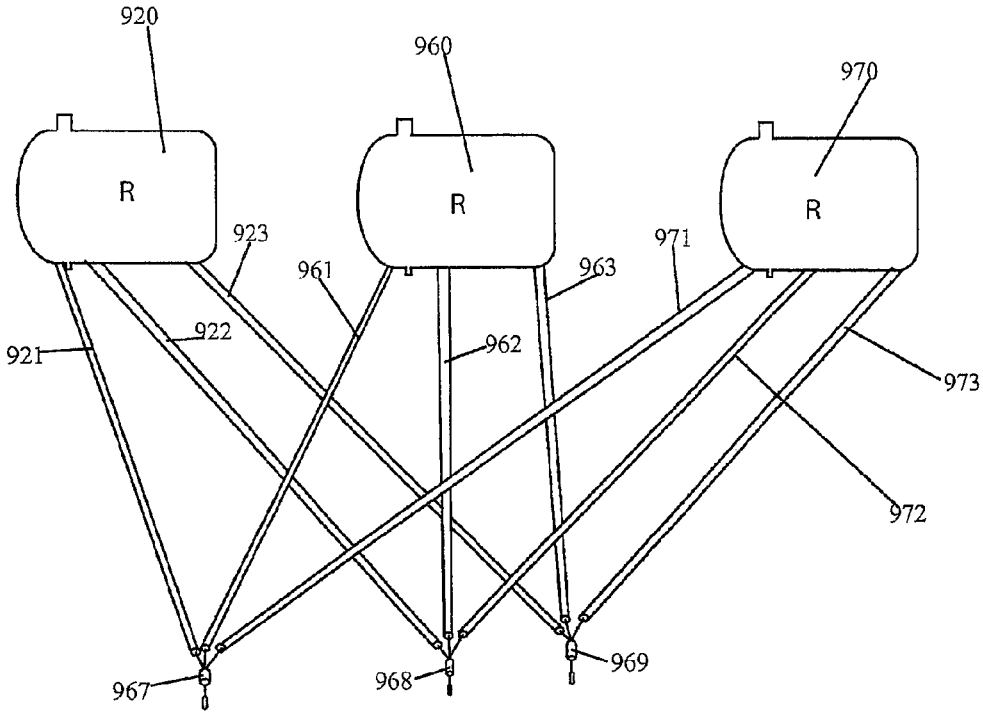
FIG. 27 shows a series of wiring modules in a fourth wiring configuration.

FIG. 27 discloses three different wiring modules which are coupled together, wherein these three different wiring modules 920, 960 and 970 are each for coupling to functional modules such as receptacles. With this design, there are three connectors 967, 968, and 969 which are used to connect the phase, neutral and ground lines together. For example connector 967 is used to connect neutral lines 921, 961, and 971 together Connector 968 could be used to connect ground lines 922, 962, and 972 together, while connector 969 could be used to connect hot lines 923, 963, and 973 together. With this design, a single power distribution cable having three different lines including a phase line, a neutral line, and a ground line together could be coupled via a single set of coupling points to provide power to three different connection interfaces which would then provide power to three different functional modules such as a triple ganged receptacle.

Figure 28:
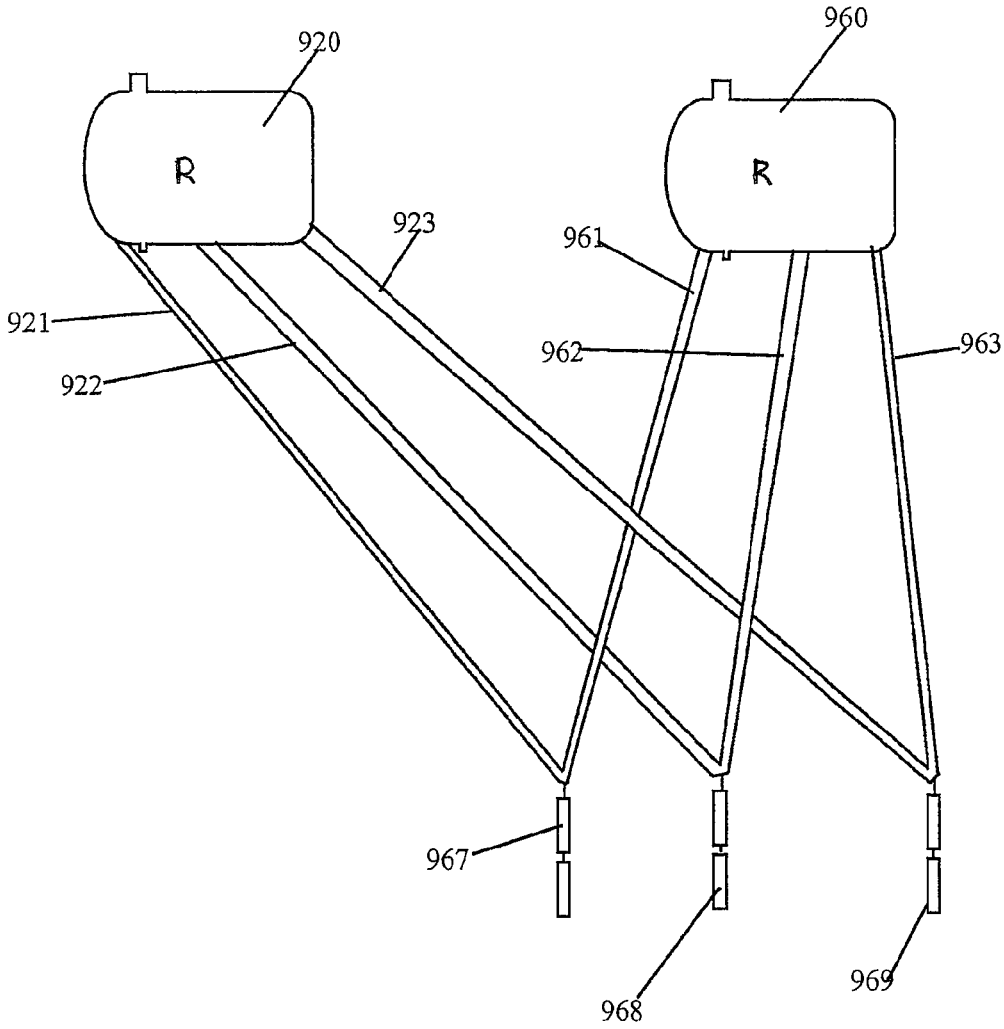
FIG. 28 shows a series of wiring modules in a fifth wiring configuration.

FIG. 28 shows wiring module 920 which is electrically coupled to wiring module 960 for the connection to a double ganged receptacle. Therefore similar to that shown in FIG. 27, there are three sets of connectors 967, 968, and 969 which are used to connect neutral lines 921, and 961 together, ground lines 922, and 962 together, and phase lines 923, and 963 together, to provide a single set of coupling points for a single power distribution line so that this single power distribution line can provide power to the face of these wiring modules. This allows power to be provided to two different receptacles or more particularly, a double ganged receptacle. It should be understood that this disclosure applies to any number of devices to be connected together.

Figure 29:
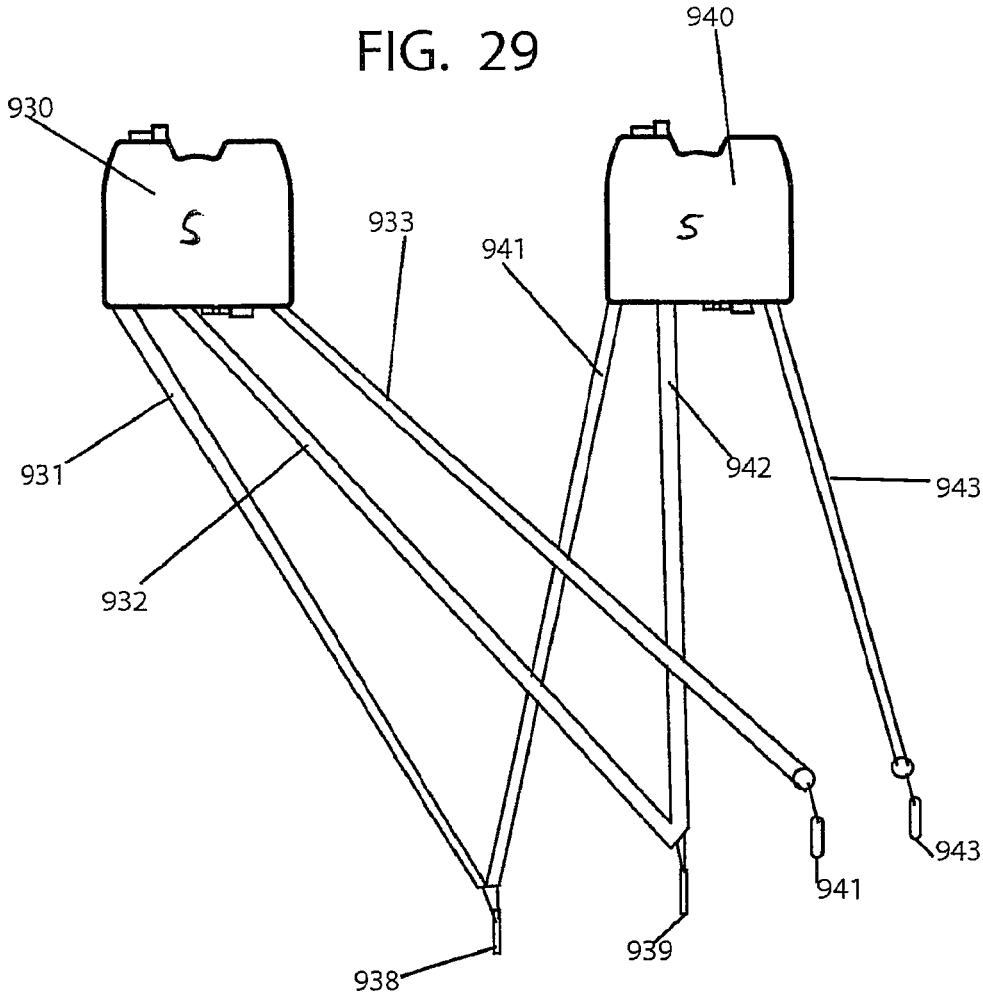
FIG. 29 shows a series of wiring modules in a sixth wiring configuration.

FIG. 29 shows another coupling configuration which shows switch wiring modules 930 and 940 which can be electrically coupled together via coupling elements 938 and 939, wherein coupling element 938 couples the phase lines 931 and 941 together, while coupling element 939 couples the ground lines 932 and 942 together. With this design, two double ganged switches can be coupled together via a single set of coupling points to a power distribution cable having a phase line, a neutral line and a ground line, so that power is provided to the face of these switch wiring modules 930 and 940, and so that corresponding switches connected to these switch wiring modules have power provided at the point of switching.

In all, the above configurations provide multiple different alternatives for wiring modules, wherein these wiring modules can be used to connect to the back of functional modules in a simplified manner. The wiring modules shown in FIGS. 16A-18G, and in FIG. 22 are configured to connect to either a switch or a receptacle, and in the case of the configuration of FIG. 22, be configured to also connect to a downstream load such that the downstream load can be selectively disconnected from power via a fault circuit. FIG. 23 shows this type of wiring module which can selectively disconnect downstream wiring modules from power. FIGS. 24-29 show the different wiring connection configurations that can be used to connect the different wiring modules together.

Accordingly, while at least one embodiment of the present invention has been shown and described, it is to be understood that many changes and modifications may be made thereunto without departing from the spirit and scope of the invention as defined in the appended claims.

What is claimed is:

1. An electrical device configured to connect to a wiring unit, the electrical device comprising:

a) a housing having a front surface and a back surface, said housing configured to engage a wall box;

b) a three-way switch disposed in said housing;

c) at least three electrically conductive connection elements and a ground pin extending from said back surface of said housing, wherein said at least three electrically conductive connection elements are spaced equidistant from said ground pin;

wherein each of said at least three electrically conductive connection elements has a connection region and at least one of said at least three connection elements is a traveler connection element;

wherein, when the electrical device is coupled to the wiring unit, at least one of said at least three conductive elements is coupled to load, at least one of said at least three conductive interfaces is coupled to line and at least one of said at least three conductive elements is coupled to a traveler line; and the ground pin is coupled to ground wherein said at least three electrically conductive connection elements are configured to allow for rotation of the electrical device with respect to the wiring unit.

2. The device as in claim 1, wherein at least one of said at least three electrically conductive connection elements comprises a body section including said connection region, and a narrower region forming a catch on said body section.

3. The device as in claim 1, wherein said at least three electrically conductive connection elements are prongs, at least one of said prongs including a post section and at least one locking section.

4. The device as in claim 3, wherein said at least one locking section is a bulb shaped region.

5. The device as in claim 1, wherein said at least three electrically conductive connection elements are arcuate blades, at least one of said arcuate blades including at least one first extending portion which is narrower than a second extending portion, thereby forming a gap for which is configured to allow said arcuate blade to lock the three way switch to the wiring unit when the three way switch and wiring unit are coupled together and then rotated into a locking position.

6. The device as in claim 1, wherein the traveler line is adapted and configured to couple the three way switch to a second three way switch.

7. The system as in claim 1, wherein said at least three electrically conductive connection elements are aligned on a circle having a radius from the ground pin.

8. The system as in claim 7, wherein said at least three electrically conductive connection elements are not spaced equidistant from each other as measured along a circumference of the circle.

9. A modular wiring system comprising:

a) a functional unit configured to be installed into a wall box, said functional unit having a front face and a back face;

b) a wiring unit; and c) a system for coupling said functional unit to said wiring unit in a rotational manner, by coupling said back face of said functional unit to said wiring unit, said system comprising at least three electrically conductive connection elements and a ground pin extending from the back face of said functional unit wherein said at least three electrically conductive connection elements are spaced equidistant from said ground pin; and at least three electrically conductive interfaces and a ground pin opening formed in said wiring unit, said at least three electrically conductive interfaces being adapted and configured to receive said at least three electrically conductive connection elements, such that when said at least three electrically conductive connection elements and said ground pin are inserted into said at least three electrically conductive interfaces and said ground pin opening, respectively, the functional unit is rotatable with respect to the wiring unit to form a locking connection and wherein at least one of said at least three conductive interfaces is coupled to load, at least one of said at least three conductive interfaces is coupled to line and at least one of said at least three conductive interfaces is coupled to a traveler line.

10. The modular wiring system as in claim 9, wherein said functional unit is a switch comprising a three way switch.

11. The modular wiring system as in claim 9, wherein at least one electrically conductive connection element of said at least three electrically conductive connection elements comprises a prong comprising a first extending section and at least one locking section comprising a bulb.

12. The modular wiring system as in claim 9, wherein at least one of said at least three electrically conductive connection elements of said functional unit is a curved arm having at least one narrower section configured as a catch.

13. The modular wiring system as in claim 9, further comprising: at least one additional nonconductive connection bracket coupled to said functional unit and configured to couple said functional unit to said wiring unit.

14. The system as in claim 9, wherein the functional unit is a three-way switch and the traveler line is adapted and configured to couple the three way switch to a second three way switch.

15. A wiring system comprising:

a wiring module comprising a housing having at least five openings with at least four of said at least five openings being elongated openings;

a functional module configured to engage a wall box, said functional module comprising a housing having at least four electrically conductive connection elements extending from said housing, said electrically conductive connection elements of said functional module being configured to insert into said openings of said wiring module and to lock said wiring module once said wiring module and said functional module are rotated with respect to each other; and a ground pin extending out from the outer surface of said functional housing.

16. The system as in claim 15, further comprising at least one additional nonconductive connection bracket coupled to said functional unit and configured to couple said functional unit to said wiring unit.

17. The system as in claim 15, wherein said wiring module comprises at least four power carrying lines and at least a fifth line comprising a ground line.

18. The system as in claim 17, wherein said at least four power carrying lines are configured to be coupled to at least four different connection interfaces, wherein said at least four connecting interfaces being configured to be coupled to said at least four electrically conductive connection elements of said functional module.

19. The system as in claim 17, wherein at least two of said at least four power carrying lines are load lines, which are configured to provide power to a downstream load, and wherein at least two electrically conductive connection elements of said at least four electrically conductive connection elements of said functional module are configured as load connection elements.

20. The system as in claim 19, wherein the functional module further comprises a fault circuit configured to disconnect said at least two load connection elements from at least one other of said electrically conductive connection elements of said functional module.

* * * * *